US006905350B1

(12) United States Patent
Wallash et al.

(10) Patent No.: US 6,905,350 B1
(45) Date of Patent: Jun. 14, 2005

(54) TWO-STEP ELECTRICAL CONNECTOR AND METHOD USING HIGH RESISTANCE PATH FOR ELECTROSTATIC DISCHARGE

(75) Inventors: Albert J. Wallash, Morgan Hill, CA (US); Kenneth Allen, Felton, CA (US)

(73) Assignee: Maxtor Corporation, Longmont, CO (US)

( * ) Notice: Subject to any disclaimer, the term of this patent is extended or adjusted under 35 U.S.C. 154(b) by 58 days.

(21) Appl. No.: 10/406,697

(22) Filed: Apr. 3, 2003

Related U.S. Application Data

(60) Provisional application No. 60/370,556, filed on Apr. 5, 2002.

(51) Int. Cl.[7] ..... H01R 4/58; H01R 13/53

(52) U.S. Cl. ..... 439/88; 439/181

(58) Field of Search ..... 439/88, 181, 183, 439/700, 482, 108

(56) References Cited

U.S. PATENT DOCUMENTS

| | | | | | |
|---|---|---|---|---|---|
| 4,050,762 | A | * | 9/1977 | Hines et al. | 439/824 |
| 4,683,422 | A | | 7/1987 | Goodson | 324/133 |
| 4,686,465 | A | * | 8/1987 | Kruger | 324/754 |
| 4,955,817 | A | | 9/1990 | Sugai | 439/60 |
| 5,256,074 | A | | 10/1993 | Tan et al. | 439/108 |
| 5,342,220 | A | | 8/1994 | Kodama | 439/607 |
| 5,409,387 | A | | 4/1995 | Northey et al. | 439/188 |
| 5,749,754 | A | * | 5/1998 | Patterson et al. | 439/824 |
| 5,978,181 | A | | 11/1999 | Niijima | 360/113 |
| 6,053,777 | A | * | 4/2000 | Boyle | 439/700 |
| 6,354,479 | B1 | | 3/2002 | Reiber et al. | 228/4.5 |

FOREIGN PATENT DOCUMENTS

| | | |
|---|---|---|
| CN | 1295252 A | 5/2001 |
| JP | 3315683 B2 | 8/2002 |

* cited by examiner

*Primary Examiner*—Chandrika Prasad
(74) *Attorney, Agent, or Firm*—Marsh Fischmann & Breyfogle LLP

(57) ABSTRACT

A method and corresponding structure for establishing an electrical interconnection is disclosed. There are at least two conductors in one embodiment. The first conductor is preferably a static dissipative material, while the second conductor may be of any conventional electrically conductive material (e.g., copper). These two conductors move relative to each other. More specifically, the first conductor is brought into contact with a device having a stored charged. After a certain amount of relative movement between the first and second conductors, and while the first conductor has remained in contact with the device to allow for dissipation of at least a portion of the charge therefrom, the second conductor is then brought into contact with the device.

50 Claims, 7 Drawing Sheets

TWO-STEP ELECTRICAL CONNECTOR AND METHOD USING HIGH RESISTANCE PATH FOR ELECTROSTATIC DISCHARGE

CROSS-REFERENCE TO RELATED APPLICATIONS

This application claims priority from U.S. Provisional Patent Application Ser. No. 60/370,556, that is entitled "ESD-FREE PROBE FOR MAGNETIC RECORDING MANUFACTURING PROCESSES INVOLVING GMR AND TMR HEADS," that was filed on Apr. 5, 2002, and the disclosure of which is incorporated by reference herein.

STATEMENTS REGARDING FEDERALLY SPONSORED RESEARCH OR DEVELOPMENT

Not applicable.

FIELD OF THE INVENTION

The present invention generally relates to the establishment of an electrical interconnection with a device and, more particularly, to contacting the device with a high resistance component to affect a slow discharge from the device prior to establishing the electrical connection and preferably such that there is no spark when making the electrical connection.

BACKGROUND OF THE INVENTION

A static charge may build up in various types of electrical components over time and for various reasons. Any charge that is stored on an electrical component, regardless of its source, may be released if an appropriate path is provided. Human contact may provide such a path, as well as when electrically interconnecting such a "charged" electrical component with another electrically conductive component.

Certain electrical components may be damaged by an abrupt discharge therefrom or from a component electrically interconnected therewith, for instance due to the electrical component being contacted by a metallic object. Giant magnetoresistive (GMR) heads for disk drives, tunneling MR and TMR heads for disk drives, and various types of integrated circuits are but a few examples of electrical components that may be adversely affected by an abrupt discharge. An abrupt discharge of a charged electrical component may render the same immediately nonfunctional, or may partially damage such a charged electrical component such that its performance degrades (immediately or over time), such that it prematurely fails, or both. These types of failures may have an adverse impact on both product yield and product reliability, both of which can have an adverse business effect.

BRIEF SUMMARY OF THE INVENTION

A first aspect of the present invention is embodied by what may be characterized as a method of establishing an electrical connection between first and second devices. The first device includes first and second conductors, with the first conductor having a significantly larger resistance than the second conductor. The method includes moving the first device relative to the second device to bring the first conductor into contact with the second device. The first conductor is moved relative to the second conductor while the first conductor remains in contact with the second device and further while the first device continues to be moved relative to the second device. The second conductor is brought into contact with the second device after a first amount of relative movement between the first and second conductors.

Various refinements exist of the features noted in relation to the first aspect of the present invention. Further features may also be incorporated in the first aspect of the present invention as well. These refinements and additional features may exist individually or in any combination. By first bringing the second device into contact with the higher resistance first conductor of the first device versus the lower resistance second conductor of the first device, any charge that exists on the second device will be more slowly dissipated. In one embodiment, electrical connection of the first and second devices is made in accordance with the first aspect without generating any spark. Preferably, the first conductor of the first device remains in contact with the second device even after the second conductor of the first device contacts the second device to establish a desired electrical connection. Any way of "tuning" the first device may be utilized in relation to how the charge is dissipated from the second device utilizing the basic methodology contemplated by the first aspect, including without limitation the resistance of one or more of the first and second conductors, the time between when contact is initially established between the second device and the higher resistance first conductor of the first device and when contact is established between the second device and the lower resistance second conductor of the first device, or both.

The second device associated with the first aspect may be an electrical component of any type/configuration. In one embodiment, the second device is a GMR head for a disk drive, a tunneling MR or TMR head for a disk drive, an integrated circuit, a microelectromechanical (MEMS) device, or a flat panel display. The first device may be of any appropriate type as well. In one embodiment, the first device is in the form of a probe or the like. However, the first device may be an electrical component or at least a device for interconnecting the second device with an electrical component (e.g., the first device may simply be an in-line connector; the first device may be a pogo pin connector). The first device may also be in the form of a coaxial cable.

The movement of the first conductor of the first device relative to the second conductor of the first device in the case of the first aspect may be provided in any appropriate manner. In one embodiment, the first conductor is mounted on a spring that is compressed after the first conductor is brought into contact with the second device and during continued movement of the first device relative to the second device so as to bring the second conductor into contact with the second device. In another embodiment, at least a portion of the first conductor deforms, deflects, or otherwise changes shape after the first conductor is brought into contact with the second device and during continued movement of the first device relative to the second device so as to bring the second conductor into contact with the second device.

The movement of the first conductor of the first device relative to the second conductor of the first device in the case of the first aspect may be characterized as changing a position of the first conductor so as to bring the second conductor into contact with the second device, so as to reduce the spacing between the second conductor and the second device, or both. The movement of the first conductor of the first device relative to the second conductor of the first device also may be characterized as moving the first conductor from a first position to a second position. In one embodiment and when the first conductor of the first device is in its first position, the second conductor of the first device is not yet in contact with the second device. Only after the first conductor has moved to its second position in this case does the second conductor of the first device come into contact with the second device. Stated another way, the second conductor of the first device may be brought into contact with the second device by a movement of the first conductor from its first position to its second position.

Another way to characterize the first aspect is that the second conductor of the first device is not brought into contact with the second device until at least a certain amount of charge from the second device has been dissipated through the first conductor after being brought into contact with the second device. This thereby contemplates that the entire charge may be removed from the second device before the second conductor of the first device is brought into contact with the second device. Yet another way to characterize the first aspect is that the second conductor of the first device is not brought into contact with the second device until the potential difference between the first and second devices is no more than about 1 volt, or the failure voltage of the second device as a result of the higher resistance first conductor of the first device contacting the second device before the lower resistance second conductor of the first device. This thereby contemplates that the first and second devices may be at the same potential when the second conductor of the first device is first brought into contact with the second device.

More than one conductor having a higher resistance than the second conductor may be used in the case of the first aspect before the second conductor of the first device is eventually brought into contact with the second device. For instance, multiple conductors of varying resistances may be utilized by the first device and sequentially brought into contact with the second device before the second conductor of the first device is brought into contact with the second device to achieve any desired effect or for any purpose. In one embodiment, the resistance of the individual conductors is sequentially reduced in some manner as these conductors are sequentially brought into contact with the second device. That is, in this embodiment the resistance of any conductor being brought into contact with the second device before the second conductor is smaller than the resistance of those conductors that have been previously brought into contact with the second device. Relatedly, the first device may contain multiple second conductors and a corresponding first conductor(s). Electrical interconnection between relevant portion of the second device and these multiple second conductors of the first device may be established in any appropriate sequence, including both simultaneously or sequentially.

As noted in relation to the first aspect, the first conductor of the first device has a significantly higher resistance than the second connector of the first device. This allows for a "slower" discharge from the second device. In one embodiment, the first conductor has a resistance of at least about $1\times10^6$ ohms. In another embodiment, the first conductor of the first device has a resistance that is at least about $1\times10^6$ ohms greater than a resistance of the second conductor of the first device (e.g., where the resistance of the second conductor may be on the order of about 1 ohm). One way to characterize the first conductor of the first device is that it is a static dissipative material. Representative static dissipative materials that may be utilized by the first aspect include ceramics, plastics, and liquids.

A second aspect of the present invention is embodied by what may be characterized as a method of establishing an electrical connection between first and second devices. The first device includes first and second conductors, with the first conductor having a significantly larger resistance than the second conductor. The method includes bringing the first conductor of the first device into contact with the second device. The first conductor is moved while the first conductor remains in contact with the second device. The second conductor is thereafter brought into contact with the second device after a first amount of movement of the first conductor.

Various refinements exist of the features noted in relation to the second aspect of the present invention. Further features may also be incorporated in the second aspect of the present invention as well. These refinements and additional features may exist individually or in any combination. By first bringing the second device into contact with the higher resistance first conductor of the first device versus the lower resistance second conductor of the first device, any charge that exists on the second device will be more slowly dissipated. In one embodiment, electrical connection of the first and second devices is made in accordance with the second aspect without generating any spark. Preferably, the first conductor of the first device remains in contact with the second device even after the second conductor of the first device contacts the second device to establish a desired electrical connection. Any way of "tuning" the first device may be utilized in relation to how the charge is dissipated from the second device utilizing the basic methodology contemplated by the second aspect, including without limitation the resistance of one or more of the first and second conductors, the time between when contact is initially established between the second device and the higher resistance first conductor of the first device and when contact is established between the second device and the lower resistance second conductor of the first device, or both.

The second device associated with the second aspect may be an electrical component of any type/configuration. In one embodiment, the second device is a GMR head for a disk drive, a tunneling MR or TMR head for a disk drive, an integrated circuit, a MEMS device or a flat panel display. The first device may be of any appropriate type as well. In one embodiment, the first device is in the form of a probe or the like. However, the first device may be an electrical component or at least a device for interconnecting the second device with an electrical component (e.g., the first device may simply be an in-line connector; the first device may be a pogo pin connector). The first device may also be in the form of a coaxial cable.

The movement of the first conductor of the first device so as to bring the second conductor of the first device into contact with the second device in the case of the second aspect may be provided in any appropriate manner. In one embodiment, the first conductor is mounted on a spring that is compressed after the first conductor is brought into contact with the second device and during continued movement of the first conductor so as to bring the second conductor into contact with the second device. In another embodiment, at least a portion of the first conductor deforms, deflects, or otherwise changes shape after the first conductor is brought into contact with the second device and during continued movement of the first conductor so as to bring the second conductor into contact with the second device.

The movement of the first conductor of the first device in the case of the second aspect may be characterized as changing a position of the first conductor so as to bring the second conductor of the first device into contact with the second device, so as to reduce the spacing between the second conductor and the second device, or both. The movement of the first conductor of the first device also may be characterized as moving the first conductor from a first position to a second position. In one embodiment and when the first conductor of the first device is in its first position, the second conductor of the first device is not yet in contact with the second device. Only after the first conductor has moved to its second position in this case does the second conductor of the first device come into contact with the second device. Stated another way, the second conductor of the first device may be brought into contact with the second device by a movement of the first conductor from its first position to its second position.

Another way to characterize the second aspect is that the second conductor of the first device is not brought into contact with the second device until at least a certain amount of charge from the second device has been dissipated through the first conductor after being brought into contact with the second device. This thereby contemplates that the entire charge may be removed from the second device before the second conductor of the first device is brought into contact with the second device. Yet another way to characterize the second aspect is that the second conductor of the first device is not brought into contact with the second device until the potential difference between the first and second devices is no more than about 1 volt, or the failure voltage of the second device, as a result of the higher resistance first conductor of the first device contacting the second device before the lower resistance second conductor of the first device. This thereby contemplates that the first and second devices may be at the same potential when the second conductor of the first device is first brought into contact with the second device.

More than one conductor having a higher resistance than the second conductor may be used in the case of the second aspect before the second conductor of the first device is eventually brought into contact with the second device. For instance, multiple conductors of varying resistances may be utilized by the first device and sequentially brought into contact with the second device before the second conductor of the first device is brought into contact with the second device to achieve any desired effect or for any purpose. In one embodiment, the resistance of the individual conductors is sequentially reduced in some manner as these conductors are sequentially brought into contact with the second device. That is, in this embodiment the resistance of any conductor being brought into contact with the second device before the second conductor is smaller than the resistance of those conductors that have been previously brought into contact with the second device. Relatedly, the first device may contain multiple second conductors and a corresponding first conductor(s). Electrical interconnection between relevant portion of the second device and these multiple second conductors of the first device may be established in any appropriate sequence, including both simultaneously or sequentially.

As noted in relation to the second aspect, the first conductor of the first device has a significantly higher resistance than the second connector of the first device. This allows for a "slower" discharge from the second device. In one embodiment, the first conductor has a resistance of at least about $1\times10^6$ ohms. In another embodiment, the first conductor of the first device has a resistance that is at least about $1\times10^6$ ohms greater than a resistance of the second conductor of the first device (e.g., where the resistance of the second conductor may be on the order of about 1 ohm). One way to characterize the first conductor of the first device is that it is a static dissipative material. Representative static dissipative materials that may be utilized by the second aspect include ceramics, plastics, and liquids.

A third aspect of the present invention is embodied by what may be characterized as a method of establishing an electrical connection between first and second devices. The first device includes first and second conductors, with the first conductor having a significantly larger resistance than the second conductor. The method includes bringing the first conductor of the first device into contact with the second device. A position of at least a portion of the first conductor is changed while the first conductor remains in contact with the second device. At least a certain amount of change in the position of the first conductor exposes the second conductor to the second device.

Various refinements exist of the features noted in relation to the third aspect of the present invention. Further features may also be incorporated in the third aspect of the present invention as well. These refinements and additional features may exist individually or in any combination. By first bringing the second device into contact with the higher resistance first conductor of the first device before exposing the lower resistance second conductor of the first device to the second device, any charge that exists on the second device will be more slowly dissipated. In one embodiment, electrical connection of the first and second devices is made in accordance with the third aspect without generating any spark. Preferably, the first conductor of the first device remains in contact with the second device even after the second conductor of the first device is exposed to the second device to establish a desired electrical connection. Any way of "tuning" the first device may be utilized in relation to how the charge is dissipated from the second device utilizing the basic methodology contemplated by the third aspect, including without limitation the resistance of one or more of the first and second conductors, the time between when contact is initially established between the second device and the higher resistance first conductor of the first device and the time when the lower resistance second conductor of the first device is exposed to the second device, or both.

The second device associated with the third aspect may be an electrical component of any type/configuration. In one embodiment, the second device is a GMR head for a disk drive, a tunneling MR or TMR head for a disk drive, an integrated circuit, a MEMS device, or a flat panel display. The first device may be of any appropriate type as well. In one embodiment, the first device is in the form of a probe or the like. However, the first device may be an electrical component or at least a device for interconnecting the second device with an electrical component (e.g., the first device may simply be an in-line connector; the first device may be a pogo pin connector). The first device may also be in the form of a coaxial cable.

Any way of changing the position of the first conductor of the first device while remaining in contact with the second device may be utilized in the case of the third aspect. In one embodiment, the first conductor is mounted on a spring that is compressed after the first conductor is brought into contact with the second device so as to change the position of the first conductor to in turn expose the second conductor of the first device to the second device. In another embodiment, at least a portion of the first conductor deforms, deflects, or otherwise changes shape after the first conductor is brought into contact with the second device to change the position of the first conductor, to in turn expose the second conductor of the first device to the second device.

The changing of the position of the first conductor of the first device in the case of the third aspect also may be characterized as changing the spacing between the second conductor and the second device, moving the first conductor from a first position to a second position, or both. In one embodiment and when the first conductor of the first device is in its first position, the second conductor of the first device is not yet in contact with the second device. Only after the first conductor has moved to its second position in this case does the second conductor of the first device come into contact with the second device. Stated another way, the second conductor of the first device may be brought into contact with the second device by a movement of the first conductor from its first position to its second position.

Another way to characterize the third aspect is that the second conductor of the first device is not exposed to the second device until at least a certain amount of charge from the second device has been dissipated through the first conductor after being brought into contact with the second device. This thereby contemplates that the entire charge may be removed from the second device before the second conductor of the first device is exposed to the second device. Yet another way to characterize the third aspect is that the second conductor of the first device is not exposed to the second device until the potential difference between the first and second devices is no more than about 1 volt, or the failure voltage of the second device, as a result of the higher resistance first conductor of the first device contacting the second device before the lower resistance second conductor of the first device is exposed to the second device. This thereby contemplates that the first and second devices may be at the same potential when the second conductor of the first device is first exposed to the second device.

More than one conductor having a higher resistance than the second conductor may be used in the case of the third aspect before the second conductor of the first device is eventually exposed to the second device. For instance, multiple conductors of varying resistances may be utilized by the first device and sequentially brought into contact with the second device before the second conductor of the first device is exposed to the second device to achieve any desired effect or for any purpose. In one embodiment, the resistance of the individual conductors is sequentially reduced in some manner as these conductors are sequentially brought into contact with the second device. That is, in this embodiment the resistance of any conductor being brought into contact with the second device, before the second conductor is exposed to the second device, is smaller than the resistance of those conductors that have been previously brought into contact with the second device. Relatedly, the first device may contain multiple second conductors and a corresponding first conductor(s). Electrical interconnection between relevant portion of the second device and these multiple second conductors of the first device may be established in any appropriate sequence, including both simultaneously or sequentially.

As noted in relation to the third aspect, the first conductor of the first device has a significantly higher resistance than the second connector of the first device. This allows for a "slower" discharge from the second device. In one embodiment, the first conductor has a resistance of at least about $1\times10^6$ ohms. In another embodiment, the first conductor of the first device has a resistance that is at least about $1\times10^6$ ohms greater than a resistance of the second conductor of the first device (e.g., where the resistance of the second conductor may be on the order of about 1 ohm). One way to characterize the first conductor of the first device is that it is a static dissipative material. Representative static dissipative materials that may be utilized by the third aspect include ceramics, plastics, and liquids.

A fourth aspect of the present invention is embodied by an electrical connector that includes first and second conductors. The first conductor has a resistance that is significantly larger than that of the second conductor, and the first conductor is movable relative to the second conductor at least between first and second positions. When the first conductor is in the first position relative to the second conductor, the first conductor extends beyond the second conductor in a first direction.

Various refinements exist of the features noted in relation to the fourth aspect of the present invention. Further features may also be incorporated in the fourth aspect of the present invention as well. These refinements and additional features may exist individually or in any combination. Having the higher resistance first conductor extend beyond the lower resistance second conductor when the first conductor is in a first position relative to the second conductor, and further having the first and second conductors be movable relative to each other, at least generally allows the first conductor to contact a device having a stored charge prior to the second conductor. Any charge that exists on this device will be more slowly dissipated in this case because of the larger resistance of the first conductor. In one embodiment, the electrical connector associated with the fourth aspect may be characterized as a sparkless, electrostatic discharge electrical connector. Preferably, the first conductor of the first device remains in contact with the device even after the second conductor of the first device contacts the device to establish a desired electrical connection. Any way of "tuning" the electrical connector may be utilized in relation to how the charge is dissipated from device, including without limitation the resistance of one or more of the first and second conductors, the time between when contact is initially established between the device and the larger resistance first conductor and when contact is established between the device and the smaller resistance second conductor, or both.

As noted in relation to the fourth aspect, the first conductor of the electrical connector has a significantly higher resistance than the second conductor. This allows for a "slower" discharge from a device that electrically interfaces with the electrical connector of the fourth aspect. In one embodiment, the first conductor has a resistance of at least about $1\times10^6$ ohms. In another embodiment, the first conductor has a resistance that is at least about $1\times10^6$ ohms greater than a resistance of the second conductor (e.g., where the resistance of the second conductor may be on the order of about 1 ohm). One way to characterize the first conductor is that it is a static dissipative material. Representative static dissipative materials that may be utilized by the fourth aspect include ceramics, plastics, and liquids.

It is a relative movement between the first and second conductors that allows the first conductor to move from a first position to a second position relative to the second conductor. Therefore, the first conductor may move while the second conductor remains stationary, the second conductor may move while the first conductor remains stationary, or both the first and second conductors may move. What is of importance is that the first conductor is disposed beyond the second conductor when the first conductor is in the first position relative to the second conductor. In this case, the larger resistance first conductor is exposed to or contacts an at least potentially charged device while the smaller resistance second conductor is not exposed or does not contact this device. However, when the first conductor is in the second position relative to the second conductor, at least a portion of the first and second conductors are at least substantially coplanar with each other so as to both be in contact with the device.

Any way of achieving relative movement between the first and second conductors that allows the larger resistance first conductor to contact a device before bringing the smaller resistance second conductor into contact with the device may be utilized. In one embodiment, the electrical connector of the fourth aspect includes a spring. One end of this spring may be fixed, while at opposite end may engage the first conductor. Compression of the spring may be utilized to move the first conductor from its first position to its second position relative to the second conductor. Another embodiment utilizes a first conductor that deforms, deflects, or otherwise changes shape to achieve the desired relative movement between the first and-second conductors. Yet another embodiment utilizes a slidable interface between the first and second conductors to achieve the desired relative movement between the first and second conductors.

The electrical connector associated with the fourth aspect may be used for any purpose. In one embodiment, the electrical connector of the fourth aspect is electrostatic discharge probe. In another embodiment, the electrical connector of the fourth aspect provides for establishing an electrical interface with a device having a charge stored thereon (e.g., electrostatic). For instance, the electrical connector of the fourth aspect could be incorporated into a pogo pin connector used in the disk drive art. In yet another embodiment, the electrical connector of the fourth aspect is utilized to electrically interconnect at least two separate devices, thereby functioning as an in-line electrical connector of sorts. In yet another embodiment, the electrical connector of the fourth aspect is in the form of a coaxial cable.

The second conductor of the electrical connector of the fourth aspect may be characterized as being recessed relative to the first conductor when the first conductor is in the first position relative to the second conductor. The amount of this recession may be reduced when the first conductor is in the second position relative to the second conductor. Reducing the amount of the recession includes a condition where the second conductor is still recessed relative to the first conductor in the second position, where the first and second conductors (e.g., an end thereof) are coplanar when in the second position, and where the second conductor actually protrudes beyond the first conductor when in the second position.

In one embodiment of the fourth aspect, either the first conductor is disposed at least partially about the second conductor, or vice versa. The "outer" one of the first and second conductors may have an annular extent or something less than an annular extent (e.g., a plurality of radially spaced elements disposed radially beyond the "inner" one of the first and second conductors). The first and second conductors may be concentrically disposed in another embodiment.

The electrical connector of the fourth aspect may be a stand-alone device (e.g., an in-line connector), or may be part of a larger device. For instance, the electrical connector may be in the form of a probe or a coaxial cable.

DETAILED DESCRIPTION OF THE INVENTION

The present invention will now be described in relation to the accompanying drawings which at least assist in illustrating its various pertinent features. Generally, the present invention allows for a desired discharge of an electrostatic charge. Preferably, this electrostatic discharge occurs without generating any spark. Therefore, the following embodiments all may be characterized as a sparkless electrostatic discharge devices of the noted type (e.g., a sparkless electrostatic discharge probe, a sparkless electrostatic discharge connector, a sparkless electrostatic discharge coaxial cable).

Figure 1:
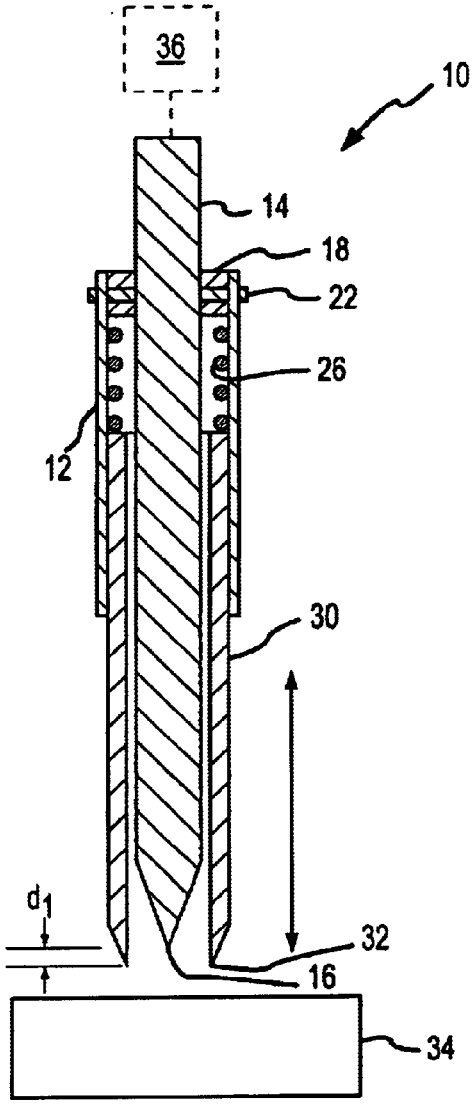
FIG. 1 is a cross-sectional view of one embodiment of an electrostatic discharge probe.

One embodiment of an electrostatic discharge probe 10 is illustrated in FIG. 1. The probe 10 includes an electrostatic discharge or ESD conductor 30 that is disposed at least partially about an electrical conductor 14. The ESD conductor 30 could be annular or defined by one or more radially spaced segments disposed radially outwardly from the electrical conductor 14. The ESD conductor 30 and the electrical conductor 14 may be concentrically disposed as well.

The probe 10 of FIG. 1 further includes a collar 18 that is fixed to the electrical conductor 14 in any appropriate manner (e.g., by one or more set screws 22). An annular shell 12 (e.g., cylindrical) of the probe 10 is disposed about a portion of the electrical conductor 14 in radially spaced relation thereto. A metal spring 26 of the probe 10 is disposed in the annular space between the shell 12 and the electrical conductor 14. Any other type of biasing member may be used in place of the spring 26 (e.g., an elastomer). One end of the spring 26 engages the collar 18, while an opposite end of the spring 26 engages the ESD conductor 30. The ends of the spring 26 may be mounted to the collar 18 and the ESD conductor 30 to retain the ESD conductor 30 in an assembled condition. Any way of retaining the electrical conductor 14 and the ESD conductor 30 in an assembled condition may be utilized. Moreover, any way of transmitting an electrical signal from the electrical conductor 14 to the desired location(s) of the probe 10 may be utilized as well.

The ESD conductor 30 and electrical conductor 14 of the probe 10 move relative to each other in the direction indicated by the two-headed arrow in FIG. 1, and are sequentially brought into engagement or contact with a device 34 in a manner so as to at least reduce the potential for damage to one or more electrical components of the device 34. The device 34 may be of any type/configuration, including without limitation a GMR head for a disk drive, a tunneling MR or TMR head for a disk drive, an integrated circuit, a MEMS device, and flat panel displays. In any case, the device 34 may have a stored charge that will be released/dissipated when contacted by the probe 10 (e.g., an electrostatic charge, but including any type of charge). Generally, the ESD conductor 30 is formed from a static dissipative material, while the electrical conductor 14 may be formed from any appropriate electrically conductive material. Representative materials for the ESD conductor 30 include ceramics, plastics, and liquids. Representative materials for the electrical conductor 14 include any material commonly used for electrical conductance. That is, the resistance of the ESD conductor 30 is larger than, and more preferably significantly larger than, the resistance of the electrical conductor 14. In one embodiment, the resistance of the ESD conductor 30 is at least about $1\times10^6$ ohms. In another embodiment, the resistance of the ESD conductor 30 is at least about $1\times10^6$ ohms greater than the resistance of the electrical conductor 14, which in one embodiment is about 1 ohm. In any case, the rate at which the charge is dissipated from the device 34 through the ESD conductor 30 is slower, and more preferably substantially slower, than the rate at which this same charge would be dissipated from the device 34 through an initial engagement with the electrical conductor 14. However, the probe 10 is configured such that the EDS conductor 30 engages the device 34 before the electrical conductor 14, to thereby reduce the potential that one or more electrical components of the device 34 will be damaged by electrically interconnecting the device 34 with the probe 10.

The end 32 of the ESD conductor 30 extends beyond the end 16 of the electrical conductor 14 prior to the probe 10 engaging the device 34. This spaced relationship is represented by the distance $d_1$ in FIG. 1. That is, the electrical conductor 14 is recessed relative to the ESD conductor 30 in the position illustrated in FIG. 1. As such, when there is relative movement of the probe 10 toward the device 34, the ESD conductor 30 will contact an electrically conductive portion of the device 34 for at least a certain amount of time before the electrical conductor 14 is brought into direct contact with an electrically conductive portion of the device 34. That is, the end 32 of the ESD conductor 30 will initially engage the device 34 when the probe 10 and device 34 are moved toward each other, while the end 16 of the electrical conductor 14 is still disposed in spaced relation to the device 34. As the probe 10 and device 34 are further advanced toward each other, the ESD connector 30 moves relative to the electrical conductor 14 by compression of the spring 26 between the collar 18 and the ESD conductor 30. After the spring 26 has compressed a certain amount, the end 16 of the electrical conductor 14 will directly contact the device 34. In the illustrated embodiment, this is when the end 16 of the electrical conductor 14 is coplanar with the end 32 of the ESD conductor 30. However, this need not always be the case, depending upon, for instance, the configuration of the device 34. For instance, the electrical conductor 14 could still be recessed relative to the ESD conductor 30 when brought into contact with the device 34, or the electrical conductor 14 could actually extend beyond the ESD conductor 30 when brought into contact with the device 34 (not shown).

Having the ESD conductor 30 contact the device 34 for at least a certain amount of time before the electrical conductor 14 directly contacts the device 34 allows the magnitude of a charge stored on the device 34 to at least be reduced before the desired electrical interconnection is established between the probe 10 and the device 34 (desired electrical interconnection being from the device 34 and directly to/through the lower resistance electrical conductor 14). Preferably, the entire charge is dissipated from the device 34 through the ESD conductor 30 before the electrical conductor 14 directly contacts the device 34 to establish the desired electrical interconnection between the probe 10 and the device 34. Stated another way, having the ESD conductor 30 contact the device 34 for a certain amount of time before the electrical conductor 14 directly contacts the device 34 allows the potential difference between the device 34 and the probe 10 to at least be reduced before the desired electrical interconnection is established between the probe 10 and the device 34. Preferably, the potential between the probe 10 and the device 34 is equalized before the electrical conductor 14 contacts the device 34 to establish the desired electrical connection between the probe 10 and device 34. The probe 10 may be tuned in any appropriate manner in relation to how the charge should be dissipated from the device 34 before having the electrical conductor 14 directly contact the device 34 to establish the desired electrical connection between the probe 10 and the device 34. Factors that may affect how the charge is dissipated from the device 34 through the ESD conductor 30 include the resistance of the ESD conductor 30 and the time between when the ESD conductor 30 contacts the device 34 and the time when the electrical conductor 14 contacts the device 34.

In summary, the electrical conductor 14 and the ESD conductor 30 of the probe 10 move relative to each other between at least two different positions. These two positions are generally as follows. In one position, the ESD conductor 30 is engaged with the device 34, while the electrical conductor 14 is disposed in spaced relation to the device 34. Therefore, the ESD conductor 30 is electrically interconnected with the device 34 in this first relative position to allow a charge to be removed therefrom in a desired manner (e.g., slowly via the high resistance of the ESD conductor 30, and not initially through the lower resistance electrical conductor 14). This is the relative position illustrated in FIG. 1. The ESD conductor 30 also moves relative to the electrical conductor 14 so as to decrease the spacing between the electrical conductor 14 and the device 34, and to eventually bring the electrical conductor 14 into direct engagement with the device 34. This defines a second relative position. Typically, the ESD conductor 30 will also remain in contact with the device 34 in this second relative position, although such need not be the case. When the probe 10 is disengaged from the device 34, the ESD conductor 30 moves relative to the electrical conductor 14 back to the position illustrated in FIG. 1 (e.g., by an appropriate biasing force being exerted on the ESD conductor 30, namely by the spring 26 in the illustrated embodiment).

The configuration used by the probe 10 to establish an electrical connection may be used by any electrical device, including without limitation an in-line connector or in a pogo pin connector for any application. In the second instance, the electrical conductor 14 could be in the form of a conventional pogo pin. Here the electrical conductor 14 would be acted upon by an appropriate biasing member 36 (e.g., a spring or the like) that is schematically depicted in FIG. 1. Any number of pogo pins in a pogo pin connector could use the configuration used by the probe 10 in FIG. 1.

FIGS. 2–8 illustrate a number of additional embodiments of electrostatic discharge probes that have the same general structural and functional characteristics as the probe 10 of FIG. 1. Although these configurations will be described in relation to a probe, as in the case of the FIG. 1 embodiment, it should be appreciated that each of these configurations may be used in any device to establish an electrical connection with any other device. For instance any of the configurations to now be discussed in relation to FIGS. 2–8 to provide a two-step electrical connection may be used by an in-line connector or in a pogo pin connector for any application.

Figure 2:
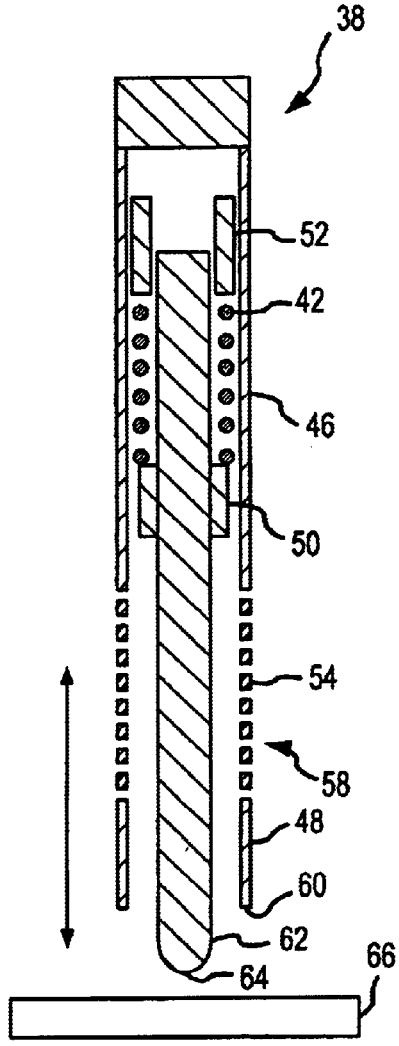
FIG. 2 is a cross-sectional view of another embodiment of an electrostatic discharge probe.

FIG. 2 depicts an electrostatic discharge probe 38. The probe 38 generally includes an electrical conductor 58 and an electrostatic or ESD conductor 62 that move relative to each other in the direction indicated by the two-headed arrow in FIG. 2, and are sequentially brought into engagement or contact with a device 66 in a manner so as to at least reduce the potential for damage to one or more electrical components of the device 66. The electrical conductor 58 is disposed at least partially about the ESD conductor 62 in radially spaced relation thereto, and generally includes a metal spring 54, a metal upper ring 46, and a metal lower ring 48. The electrical conductor 58 could be annular or defined by one or more radially spaced segments disposed radially outwardly from the ESD conductor 62. The electrical conductor 58 and ESD conductor 62 may be concentrically disposed as well.

The probe 38 further includes a lower collar 50 that is fixed to the ESD conductor 62, as well as an upper collar 52 that is fixed to the upper ring 46. A metal spring 42 of the probe 38 is disposed in the space between the upper ring 46 of the electrical conductor 58 and the ESD conductor 62. Any other type of biasing member may be used in place of the spring 42 (e.g., an elastomer). One end of the spring 42 engages the upper collar 52 that is fixed to the upper ring 46 of the electrical conductor 58, while an opposite end of the spring 42 engages the lower collar 50 that is fixed to the ESD conductor 62. The ends of the spring 42 may be mounted to the upper collar 52 and the lower collar 50 to retain the ESD conductor 62 in an assembled condition. Any way of retaining the electrical conductor 58 and the ESD conductor 62 in an assembled condition may be utilized. Moreover, any way of transmitting an electrical signal from the electrical conductor 58 to the desired location(s) of the probe 38 may be utilized as well.

The end 64 of the ESD conductor 62 extends beyond the end 60 of the electrical conductor 58 prior to the probe 38 engaging the device 66. That is, the electrical conductor 58 is recessed relative to the ESD conductor 62 in the position illustrated in FIG. 2. As such, when there is relative movement of the probe 38 toward the device 66, the ESD conductor 62 will contact an electrically conductive portion of the device 66 for at least a certain amount of time before the electrical conductor 58 is brought into direct contact with an electrically conductive portion of the device 66. That is, the end 64 of the ESD conductor 62 will initially engage the device 66 when the probe 38 and device 66 are moved toward each other, while the end 60 of the electrical conductor 58 is still disposed in spaced relation to the device 66. As the probe 38 and device 66 are further advanced toward each other, the ESD conductor 62 moves relative to the electrical conductor 58 by compression of the spring 42. After the spring 42 has compressed a certain amount, the end 60 of the electrical conductor 58 will directly contact the device 66. In the illustrated embodiment, this when the ends 60 and 64 are coplanar, although such need not be the case in the same manner noted above in relation to the probe 10 of FIG. 1. In any case, further advancement of the probe 38 relative to the device 66 may compress the spring 54 of the electrical conductor 58. Compression of the spring 54 may be desired/required.

In summary, the electrical conductor 58 and the ESD conductor 62 of the probe 38 move relative to each other between at least two different positions in the same general manner as in the case of the probe 10 of FIG. 1. These two positions are generally as follows. In one position, the ESD conductor 62 is engaged with the device 66, while the electrical conductor 58 is disposed in spaced relation to the device 66. Therefore, the ESD conductor 62 is electrically interconnected with the device 66 in this first relative position to allow a charge to be removed therefrom in a desired manner (e.g., slowly via the high resistance of the ESD conductor 62), and not initially through the lower resistance electrical conductor 58. This is the relative position illustrated in FIG. 2. The ESD conductor 62 also moves relative to the electrical conductor 58 so as to decrease the spacing between the electrical conductor 58 and the device 66, and to eventually bring the electrical conductor 58 into direct engagement with the device 66. This defines a second relative position. Typically, the ESD conductor 62 will also remain in contact with the device 66 in this second relative position, although such need not be the case. When the probe 38 is disengaged from the device 66, the ESD conductor 62 moves relative to the electrical conductor 58 back to the position illustrated in FIG. 2 (e.g., by an appropriate biasing force being exerted on the ESD conductor 62, namely by the spring 42 in the illustrated embodiment).

Figure 3:
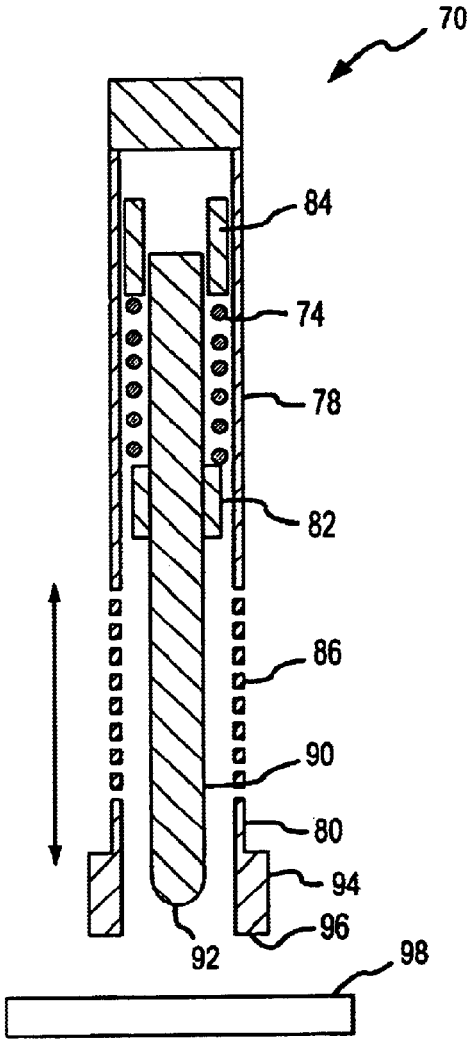
FIG. 3 is a cross-sectional view of another embodiment of an electrostatic discharge probe.

FIG. 3 depicts an electrostatic discharge probe 70. The probe 70 generally includes an electrical conductor 90 and an electrostatic or ESD conductor 94 that move relative to each other in the direction indicated by the two-headed arrow in FIG. 3, and are sequentially brought into engagement with or contact a device 98 in a manner so as to at least reduce the potential for damage to one or more electrical components of the device 98. The ESD conductor 94 is disposed at least partially about the electrical conductor 98 in radially spaced relation thereto in the same general manner discussed above in relation to the probe 10 of FIG. 1, and is interconnected with a remainder of the probe 70 by a metal lower ring 80, a metal spring 86, and a metal upper ring 78. The probe 70 further includes a lower collar 82 that is fixed to the electrical conductor 90, as well as an upper collar 84 that is fixed to the upper ring 78. A metal spring 74 of the probe 70 is disposed in the space between the upper ring 78 and the electrical conductor 90. Any other type of biasing member may be used in place of the spring 74 (e.g., an elastomer). One end of the spring 74 engages the upper collar 84 that is fixed to the upper ring is 78, while an opposite end of the spring 74 engages the lower collar 82 that is fixed to the electrical conductor 90. The ends of the spring 74 may be mounted to the upper collar 84 and the lower collar 82 to retain the electrical conductor 90 and ESD conductor 94 in an assembled condition. Any way of retaining the electrical conductor 90 and ESD conductor 94 in an assembled condition may be utilized. Moreover, any way of transmitting an electrical signal from the electrical conductor 90 to the desired location(s) of the probe 70 may be utilized as well.

The end 96 of the ESD conductor 94 extends beyond the end 92 of the electrical conductor 90 prior to the probe 70 engaging the device 98. That is, the electrical conductor 90 is recessed relative to the ESD conductor 94 in the position illustrated in FIG. 3. As such, when there is relative movement of the probe 70 toward the device 98, the ESD conductor 94 will contact an electrically conductive portion of the device 98 for at least a certain amount of time before the electrical conductor 90 is brought into direct contact with an electrically conductive portion of the device 98. That is, the end 96 of the ESD conductor 94 will initially engage the device 98 when the probe 70 and device 98 are moved toward each other, while the end 92 of the electrical conductor 90 is still disposed in spaced relation to the device 98. As the probe 70 and device 98 are further advanced toward each other, the ESD conductor 96 moves relative to the electrical conductor 90 by compression of the spring 86. After the spring 86 has compressed a certain amount, the end 92 of the electrical conductor 90 will contact the device 98. In the illustrated embodiment, this is when the ends 92 and 96 are coplanar, although such need not be the case in the same manner noted above in relation to the probe 10 of FIG. 1. In any case, further advancement of the probe 70 relative to the device 98 may compress the spring 74 associated with the electrical conductor 90. Compression of the spring 74 may be desired/required.

In summary, the electrical conductor 90 and the ESD conductor 94 of the probe 70 move relative to each other between at least two different positions in the same general manner as in the case of the probe 10 of FIG. 1. These two positions are generally as follows. In one position, the ESD conductor 94 is engaged with the device 98, while the electrical conductor 90 is disposed in spaced relation to the device 98. Therefore, the ESD conductor 94 is electrically interconnected with the device 98 in this first relative position to allow a charge to be removed therefrom in a desired manner (e.g., slowly via the high resistance of the ESD conductor 94, and not initially through the electrical conductor 90). This is the relative position illustrated in FIG. 3. The ESD conductor 94 also moves relative to the electrical conductor 90 so as to decrease the spacing between the electrical conductor 90 and the device 98, and to eventually bring the electrical conductor 90 into engagement with the device 98. This defines a second relative position. Typically, the ESD conductor 94 will also remain in contact with the device 98 in this second relative position, although such need not be the case. When the probe 70 is disengaged from the device 98, the ESD conductor 94 moves relative to the electrical conductor 90 back to the position illustrated in FIG. 3 (e.g., by an appropriate biasing force being exerted on the ESD conductor 94, namely by the spring 86 in the illustrated embodiment).

Figure 4:
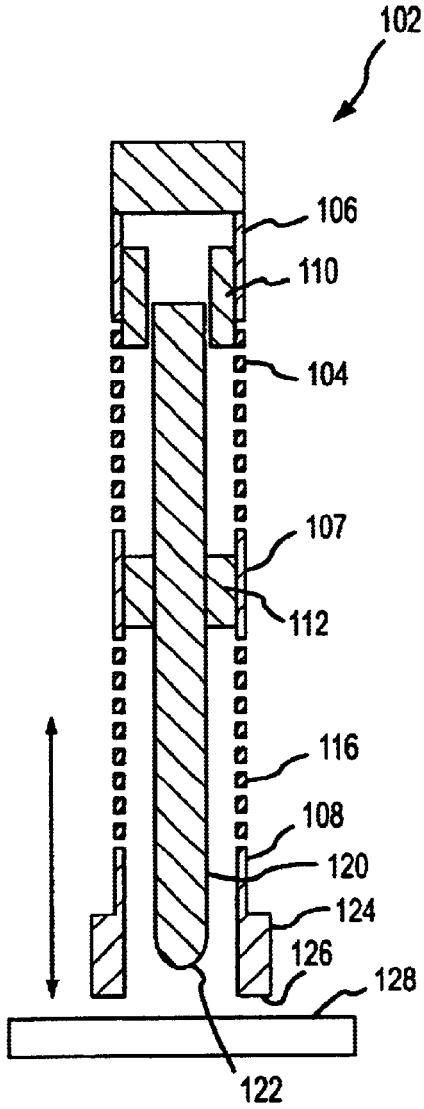
FIG. 4 is a cross-sectional view of another embodiment of an electrostatic discharge probe.

FIG. 4 depicts an electrostatic discharge probe 102. The probe 102 generally includes an electrical conductor 120 and an electrostatic or ESD conductor 124 that move relative to each other in the direction indicated by the double-headed arrow in FIG. 4, and are sequentially brought into engagement with or contact a device 128 in a manner so as to at least reduce the potential for damage to one or more electrical components of the device 128. The ESD conductor 124 is disposed at least partially about the electrical conductor 120 in radially spaced relation thereto in the same general manner as the probe 70 of FIG. 3, and is interconnected with a remainder of the probe 102 by a metal lower ring 108, a lower metal spring 116, a metal intermediate ring 107, an upper metal spring 104, and a metal upper ring 106. The probe 102 further includes a lower collar 108 that is fixed to the electrical conductor 120, as well as an upper collar 110 that is fixed to the upper ring 106. Any way of retaining the electrical conductor 120 and the ESD conductor 124 in an assembled condition may be utilized. Moreover, any way of transmitting an electrical signal from the electrical conductor 120 to the desired location(s) of the probe 102 maybe utilized as well.

The end 126 of the ESD conductor 124 extends beyond the end 122 of the electrical conductor 120 prior to the probe 102 engaging the device 128. That is, the electrical conductor 120 is recessed relative to the ESD conductor 124 in the position illustrated in FIG. 4. As such, when there is relative movement of the probe 102 toward the device 128, the ESD conductor 124 will contact an electrically conductive portion of the device 128 for at least a certain amount of time before the electrical conductor 120 is brought into direct contact with an electrically conductive portion of the device 128. That is, the end 122 of the ESD conductor 124 will initially engage the device 128 when the probe 102 and device 128 are moved toward each other, while the end 122 of the electrical conductor 120 is still disposed in spaced relation to the device 128. As the probe 102 and device 128 are further advanced toward each other, the ESD conductor 124 moves relative to the electrical conductor 120 by compression of the spring 116. After the spring 116 has compressed a certain amount, the end 122 of the electrical conductor 120 will directly contact the device 128. In the illustrated embodiment, this is when the ends 122 and 126 are coplanar, although such need not be the case in the same manner noted above in relation to the probe 10 of FIG. 1. In any case, further advancement of the probe 102 relative to the device 128 may compress the spring 104 associated with the electrical conductor 120. Compression of the spring 104 may be desired/required.

In summary, the electrical conductor 120 and the ESD conductor 124 of the probe 102 move relative to each other between at least two different positions in the same general manner as in the case of the probe 10 of FIG. 1. These two positions are generally as follows. In one position, the ESD conductor 124 is engaged with the device 128, while the electrical conductor 120 is disposed in spaced relation to the device 128. Therefore, the ESD conductor 124 is electrically interconnected with the device 128 in this first relative position to allow a charge to be removed therefrom in a desired manner (e.g., slowly via the high resistance of the ESD conductor 124, and not initially through the electrical conductor 120). This is the relative position illustrated in FIG. 4. The ESD conductor 124 also moves relative to the electrical conductor 120 so as to decrease the spacing between the electrical conductor 120 and the device 128, and to eventually bring the electrical conductor 120 into engagement with the device 128. This defines a second relative position. Typically, the ESD conductor 124 will also remain in contact with the device 128 in this second relative position, although such need not be the case. When the probe 102 is disengaged from the device 128, the ESD conductor 124 moves relative to the electrical conductor 120 back to the position illustrated in FIG. 4 (e.g., by an appropriate biasing force being exerted on the ESD conductor 124, namely by the spring 116 in the illustrated embodiment).

Figure 5:
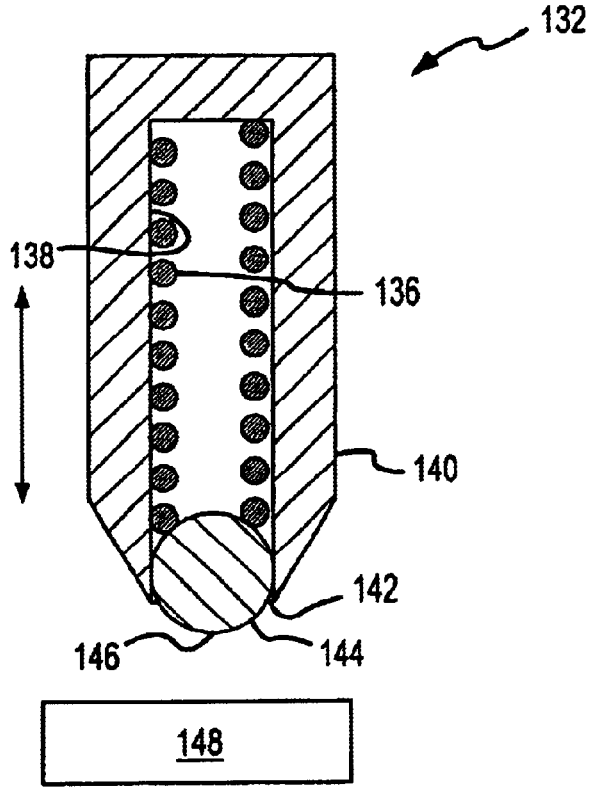
FIG. 5 is a cross-sectional view of another embodiment of an electrostatic discharge probe.

FIG. 5 depicts an electrostatic discharge probe 132. The probe 132 generally includes an electrical conductor 140 and an electrostatic or ESD conductor 144 that move relative to each other in the direction indicated by the double-headed arrow in FIG. 5, and are sequentially brought into engagement with or contact a device 148 in a manner so as to at least reduce the potential for damage to one or more electrical components of the device 148. The ESD conductor 144 is disposed within an aperture 138 formed in the electrical conductor 140. A spring 136 is also disposed within the aperture 138 between a closed end of the electrical conductor 140 and the ESD conductor 144. Any way of retaining the electrical conductor 140 and the ESD conductor 144 in an assembled condition may be utilized.

Moreover, any way of transmitting an electrical signal from the electrical conductor 140 to the desired location(s) of the probe 132 may be utilized as well.

An end 146 of the ESD conductor 144 extends beyond an end 144 of the electrical conductor 142 prior to the probe 132 engaging the device 148. That is, the electrical conductor 142 is recessed relative to the ESD conductor 144. As such, when there is relative movement of the probe 132 toward the device 148, the ESD conductor 144 will contact an electrically conductive portion of the device 148 for at least a certain amount of time before the electrical conductor 140 is brought into direct contact with an electrically conductive portion of the device 148. That is, the end 146 of the ESD conductor 144 will initially engage the device 148 when the probe 132 and device 148 are moved toward each other, while the end 142 of the electrical conductor 140 is still disposed in spaced relation to the device 148. As the probe 132 and device 148 are further advanced toward each other, the ESD conductor 144 moves relative to the electrical conductor 140 by compression of the spring 136. After the spring 136 has compressed a certain amount, the end 144 of the electrical conductor 140 will directly contact the device 148. In the illustrated embodiment, this is when the ends 142 and 146 are coplanar, although such need not be the case in the same manner noted above in relation to the probe 10 of FIG. 1.

In summary, the electrical conductor 140 and the ESD conductor 144 of the probe 132 move relative to each other between at least two different positions in the same general manner as the probe 10 of FIG. 1. These two positions are generally as follows. In one position, the ESD conductor 144 is engaged with the device 148, while the electrical conductor 140 is disposed in spaced relation to the device 148. Therefore, the ESD conductor 144 is electrically interconnected with the device 148 in this first relative position to allow a charge to be removed therefrom in a desired manner (e.g., slowly via the high resistance of the ESD conductor 144, and not initially through the lower resistance electrical conductor 140). This is the relative position illustrated in FIG. 5. The ESD conductor 144 also moves relative to the electrical conductor 140 so as to decrease the spacing between the electrical conductor 140 and the device 148, and to eventually bring the electrical conductor 140 into engagement with the device 148. This defines a second relative position. Typically, the ESD conductor 144 will also remain in contact with the device 148 in this second relative position, although such need not be the case. When the probe 132 is disengaged from the device 148, the ESD conductor 144 moves relative to the electrical conductor 140 back to the position illustrated in FIG. 5 (e.g., by an appropriate biasing force being exerted on the ESD conductor 144, namely by the spring 136 in the illustrated embodiment).

Figure 6:
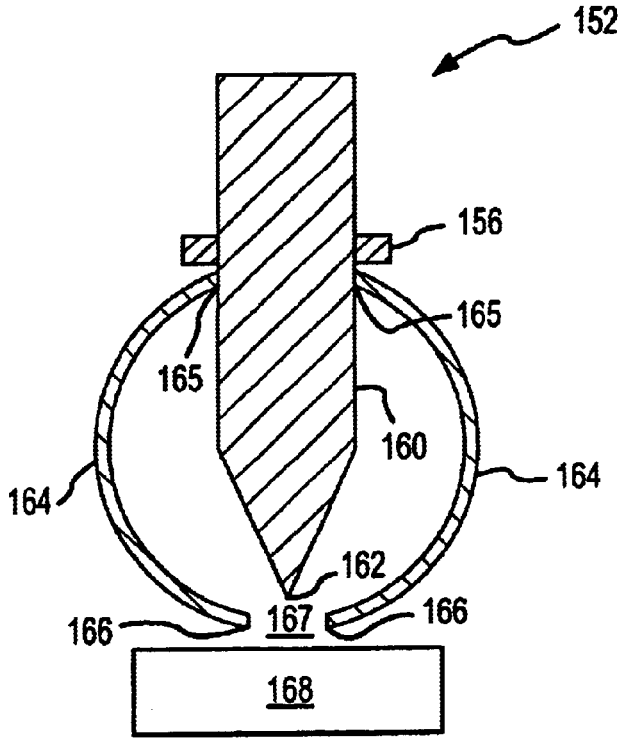
FIG. 6 is a cross-sectional view of another embodiment of an electrostatic discharge probe.

FIG. 6 depicts an electrostatic discharge probe 152. The probe 152 generally includes an electrical conductor 116 and an ESD conductor 164 that move relative to each other at least generally in the direction indicated by the double-headed arrow in FIG. 6, and are sequentially lo brought into engagement with or contact a device 168 in a manner so as to at least reduce the potential for damage to one or more electrical components of the device 168. The ESD conductor 164 may be of an annular configuration, or a plurality of radially spaced ESD conductors 164 may be utilized. In any case, the ESD conductor(s) 164 is made of a deformable material and may be of any appropriate shape so as to bend or otherwise deform so as to bring the electrical conductor 160 into contact with the device 168 in the manner described below. One end 165 of the ESD conductor(s) 164 is fixed to the electrical conductor 160 at a collar 156, while an opposite end 165 of the ESD conductor(s) 164 is free and is disposed beyond an end 162 of the electrical conductor 160. A space 167 is provided at the end 166 of the ESD conductor 164 to allow for the passage of the electrical conductor 160 therein/therethrough. Any way of retaining the electrical conductor 160 and the ESD conductor 164 in an assembled condition may be utilized. Moreover, any way of transmitting an electrical signal from the electrical conductor 160 to the desired location(s) on the probe 152 may be utilized as well.

An end 166 of ESD conductor(s) 164 extends beyond an end 162 of the electrical conductor 160 prior to the probe 152 engaging the device 168. That is, the electrical conductor 160 is recessed relative to the ESD conductor(s) 164. As such, when there is relative movement of the probe 152 toward the device 168, the ESD conductor(s) 164 will contact an electrically conductive portion of the device 168 for at least a certain amount of time before the electrical conductor 160 is brought into direct contact with an electrically conductive portion of the device 168. That is, the end 166 of the ESD conductor(s) 144 will initially engage the device 168 when the probe 152 and device 168 are moved toward each other, while the end 162 of the electrical conductor 160 is still disposed in spaced relation to the device 168. As the probe 152 and device 168 are further advanced toward each other, the ESD conductor(s) 164 moves relative to the electrical conductor 160 by deformation (e.g., bending, bowing) between the end(s) 165 and the end(s) 166 (to reduce the spacing between the end(s) 165 and the end(s) 166). After the distance between the end(s) 165 and end(s) 166 of the ESD conductor(s)164 has decreased by a certain amount, the end 162 of the electrical conductor 160 will directly contact the device 168. In the illustrated embodiment, this is when the ends 162 and 166 are coplanar, although such need not is be the case in the same manner noted above in relation to the probe 10 of FIG. 1.

In summary, the electrical conductor 160 and the ESD conductor(s) 164 of the probe 152 move relative to each other between at least two different positions in the same general manner as the probe 10 of FIG. 1. These two positions are generally as follows. In one position, the ESD conductor(s) 164 is engaged with the device 168, while the electrical conductor 160 is disposed in spaced relation to the device 168. Therefore, the ESD conductor(s) 164 is electrically interconnected with the device 168 in this first relative position to allow a charge to be removed therefrom in a desired manner (e.g., slowly via the high resistance of the ESD conductor(s) 164, and not initially through the lower resistance electrical conductor 160). This is the relative position illustrated in FIG. 6. The ESD conductor(s) 164 also moves relative to the electrical conductor 160 so as to decrease the spacing between the electrical conductor 160 and the device 168, and to eventually bring the electrical conductor 160 into engagement with the device 168. This defines a second relative position. Typically, the ESD conductor(s) 164 will also remain in contact with the device 168 in this second relative position, although such need not be the case. When the probe 152 is disengaged from the device 168, the ESD conductor(s) 164 moves relative to the electrical conductor 160 back to the position illustrated in FIG. 6 (e.g., by an appropriate biasing force being exerted on the ESD conductor 164, for instance by stored elastic forces that move the ESD conductor 164 back to an undeformed state).

Figure 7:
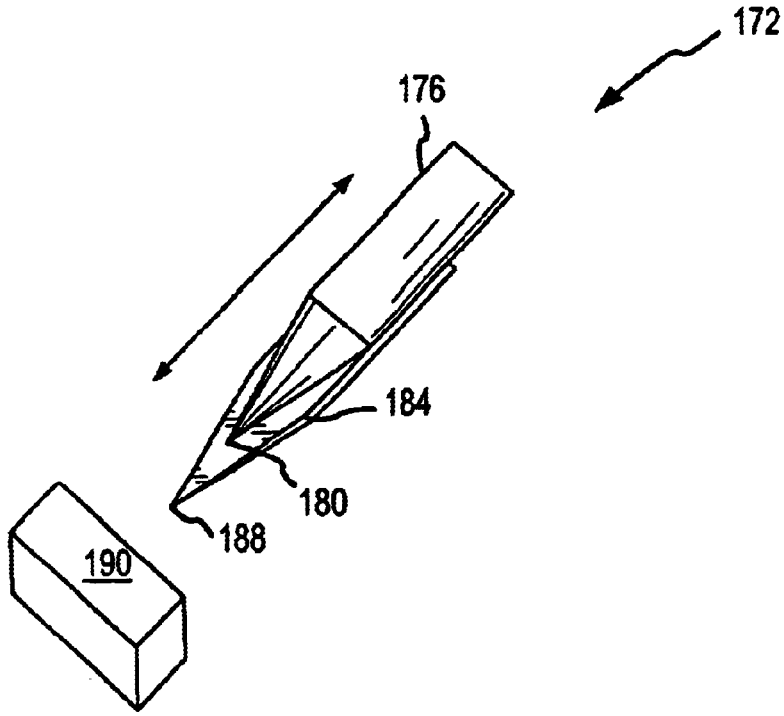
FIG. 7 is a perspective view of another embodiment of an electrostatic discharge probe.

FIG. 7 depicts an electrostatic discharge probe 172. The probe 172 generally includes an electrical conductor 176 and an ESD conductor 184 that move relative to each other at least generally in the direction indicated by the two-headed arrow in FIG. 7, and are sequentially brought into engagement with or contact a device 190 in a manner so as to at least reduce the potential for damage to one or more electrical components of the device 190. Generally, the electrical conductor 176 and the ESD conductor 184 slidably interface with each other during movement between at least two different positions. Any way of retaining the electrical conductor 176 and the ESD conductor 184 in an assembled condition and allowing for this relative movement may be utilized by the probe 172. Moreover, any way of transmitting an electrical signal from the electrical conductor 176 to the desired location(s) of the probe 172 may be utilized as well.

An end 188 of ESD conductor 184 extends beyond an end 180 of the electrical conductor 176 prior to the probe 172 engaging the device 190. That is, the electrical conductor 176 is recessed relative to the ESD conductor 184. This is the position illustrated in FIG. 7. When there is relative movement of the probe 172 toward the device 190, the ESD conductor 184 will contact an electrically conductive portion of the device 190 for at least a certain amount of time before the electrical conductor 176 is brought into direct contact with an electrically conductive portion of the device 190. That is, the end 188 of the ESD conductor 184 will initially engage the device 190 when the probe 172 and device 190 are moved toward each other, while the end 180 of the electrical conductor 176 is still disposed in spaced relation to the device 190. As the probe 172 and device 190 are further advanced toward each other, the ESD conductor 184 moves relative to the electrical conductor 176 by sliding relative to the electrical conductor 176. This movement of the ESD the conductor 184 may be opposed by an appropriate biasing mechanism (e.g., a spring, not shown). After a certain amount of relative movement between the ESD conductor 184 and the electrical conductor 176, the end 180 of the electrical conductor 176 will contact the device 190. In the illustrated embodiment, this is when the end 180 of the electrical conductor 176 and the end 188 of the ESD conductor 184 are at least substantially coplanar with each other. However, this need not always be the case in order to be able to utilize the two-step electrical connection process provided by the probe 172 and in the same manner discussed above in relation to the probe 10 of FIG. 1.

In summary, the electrical conductor 176 and the ESD conductor 184 of the probe 172 move relative to each other between at least two different positions in the same general manner as the probe 10 of FIG. 1. These two positions are generally as follows. In one position, the ESD conductor 184 is engaged with the device 190, while the electrical conductor 176 is disposed in spaced relation to the device 190. Therefore, the ESD conductor 184 is electrically interconnected with the device 190 in this first relative position to allow a charge to be removed therefrom in a desired manner (e.g., slowly via the high resistance of the ESD conductor 184, and not initially through the lower resistance electrical conductor 176). This is the relative position illustrated in FIG. 7. The ESD conductor 184 also moves relative to the electrical conductor 176 so as to decrease the spacing between the electrical conductor 176 and the device 190, and to eventually bring the electrical conductor 176 into direct engagement with the device 190. This defines a second relative position. Typically, the ESD conductor 184 will also remain in contact with the device 190 in this second relative position in order to be able to utilize the two-step electrical connection process provided by the probe 172. When the probe 172 is disengaged from the device 190, the ESD conductor 184 moves relative to the electrical conductor 176 back to the position illustrated in FIG. 7 (e.g., by an appropriate biasing force being exerted on the ESD conductor 184 (not shown)).

Figure 8:
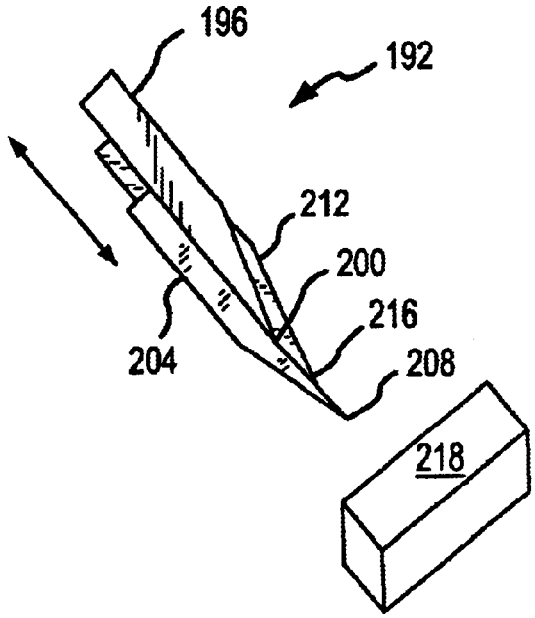
FIG. 8 is a perspective view of another embodiment of an electrostatic discharge probe.

FIG. 8 depicts an electrostatic discharge probe 192. The probe 192 generally includes an electrical conductor 196, a first ESD conductor 196, and a second ESD conductor 212 that move relative to each other at least generally in the direction indicated by the double-headed arrow in FIG. 8, and are sequentially brought into engagement with or contact a device 218 in a manner so as to at least reduce the potential for damage to one or more electrical components of the device 218. Generally, the electrical conductor 196 and each of the first ESD conductor 204 and the second ESD conductor 212 slidably interface with each other during movement between at least two different positions. Any way of retaining the electrical conductor 196, the first ESD conductor 204, and the second ESD conductor 212 in an assembled condition and allowing for this relative movement may be utilized by the probe 192. Moreover, any way of transmitting an electrical signal from the electrical conductor 196 to the desired location(s) of the probe 192 may be utilized as well.

An end 208 of the first ESD conductor 204 extends beyond an end 200 of the electrical conductor 196 and an end 216 of the second ESD conductor 212 prior to the probe 192 engaging the device 218. Similarly, the end 216 of the second ESD conductor 212 extends beyond an end 200 of the electrical conductor 196 prior to the probe 192 engaging the device 218 (more specifically prior to the second ESD conductor 212 engaging the device 218). These are the relative positions illustrated in FIG. 8. When there is relative movement of the probe 192 toward the device 218, the first ESD conductor 204 will contact an electrically conductive portion of the device 218 for at least a certain amount of time before the second ESD conductor 212 is brought into contact with an electrically conductive portion of the device 218, and also before the electrical conductor 196 is brought into contact with an electrically conductive portion of the device 218. That is, the end 200 of the first ESD conductor 204 will initially engage the device 218 when the probe 192 and device 218 are moved toward each other, while the end 216 of the second ESD conductor 212 and the end 200 of the electrical conductor 196 are still disposed in spaced relation to the device 218.

As the probe 192 and device 218 are further advanced toward each other, the first ESD conductor 204 moves relative to both the second ESD conductor 212 and the electrical conductor 196 by a sliding motion. This movement of the first ESD conductor 204 may be opposed by an appropriate biasing mechanism (e.g., a spring, not shown). After a certain amount of relative movement between the first ESD conductor 204 and each of the second ESD conductor 212 and the electrical conductor 196, the end 216 of the second ESD conductor 212 will contact the device 218. In the illustrated embodiment, this is when the end 216 of the second ESD conductor 212 and the end 208 of the first ESD conductor 204 are at least substantially coplanar with each other. However, this need not always be the case in order to be able to utilize the two-step electrical connection process provided by the probe 192 and in the same manner discussed above in relation to the probe 10 of FIG. 1.

As the probe 192 and device 218 are yet further advanced toward each other, the second ESD conductor 212 now begins to move relative to the electrical conductor 196 by a sliding motion. This movement of the second ESD conductor 212 may be opposed by an appropriate biasing mechanism (e.g., a spring, not shown). After a certain amount of relative movement between the second ESD conductor 212 and the electrical conductor 196, the end 200 of the electrical conductor 196 will contact the device 218. In the illustrated embodiment, this is when the end 216 of the second ESD conductor 212 and the end 200 of the electrical conductor 196 are at least substantially coplanar with each other. However, this need not always be the case in order to be able to utilize the two-step electrical connection process provided by the probe 192 and in the same manner discussed above in relation to the probe 10 of FIG. 1.

The probe 192 of FIG. 8 includes multiple ESD conductors (e.g., 204, 212). Any number of ESD conductors may be utilized by the probe 192. Adjacent pairs of ESD conductors (e.g., 204, 212) will typically have different resistances. Moreover, each of these multiple ESD conductors (e.g., 204, 212) will typically have a resistance that is greater than that of the electrical conductor 196. In one embodiment, the resistance of each ESD conductor (e.g., 204, 212) that is brought into contact with the device 218 will have a resistance that is less than that of each ESD conductor (e.g., 204, 212) that has already been brought into contact with the device 218. However, the resistances of the various multiple ESD conductors (e.g., 204, 212) may be selected in any appropriate manner and to yield any appropriate result. Multiple ESD conductors (e.g., 204, 212) of the type discussed in relation to the probe 192 may be utilized by any of the probes/connectors described herein.

In summary, the electrical conductor 196, the first ESD conductor 204, and the second ESD conductor 212 of the probe 192 each move relative to each other between at least two different positions. These positions are generally as follows. While the first ESD conductor 204 is initially engaged with the device 218, the electrical conductor 196 is disposed in spaced relation to the device 218. Therefore, the first ESD conductor 204 is electrically interconnected with the device 218 to allow a charge to be removed therefrom in a desired manner (e.g., slowly via the high resistance of the first ESD conductor 204). At this same time, the second ESD conductor 212 is also disposed in spaced relation to the device 218. Both of these relative positions are illustrated in FIG. 8.

The first ESD conductor 204 also moves relative to both the second ESD conductor 212 and the electrical conductor 196 so as to decrease the spacing between the device 218 and each of the second ESD conductor 212 and the electrical conductor 196, and to eventually bring both the second,ESD conductor 212 and the electrical conductor 196 into sequential engagement with the device 218. Typically, the first ESD conductor 204 will also remain in contact with the device 218 when both the second ESD conductor 212 and the electrical conductor196 are brought into engagement with the device 218, although such need not always be the case in order to be able to utilize the two-step electrical connection process provided by the probe 192.

The second ESD conductor 212 and the electrical conductor 196 remain in the same position relative to each other until the second ESD conductor 212 is brought into engagement with the second device 218 after a certain amount of relative movement between the first ESD conductor 204 and the second ESD conductor 212. The second ESD conductor 212 then begins to move relative to the electrical conductor 196 so as to decrease the spacing between the device 218 and the electrical conductor 196, and to eventually bring the electrical conductor 196 into direct engagement with the device 218. Typically, both the first ESD conductor 204 and the second ESD conductor will also remain in contact with the device 218 when the electrical conductor 196 are brought into engagement with the device 218, although such need not always be the case in order to be able to utilize the two-step electrical connection process provided by the probe 192.

Figure 9A:
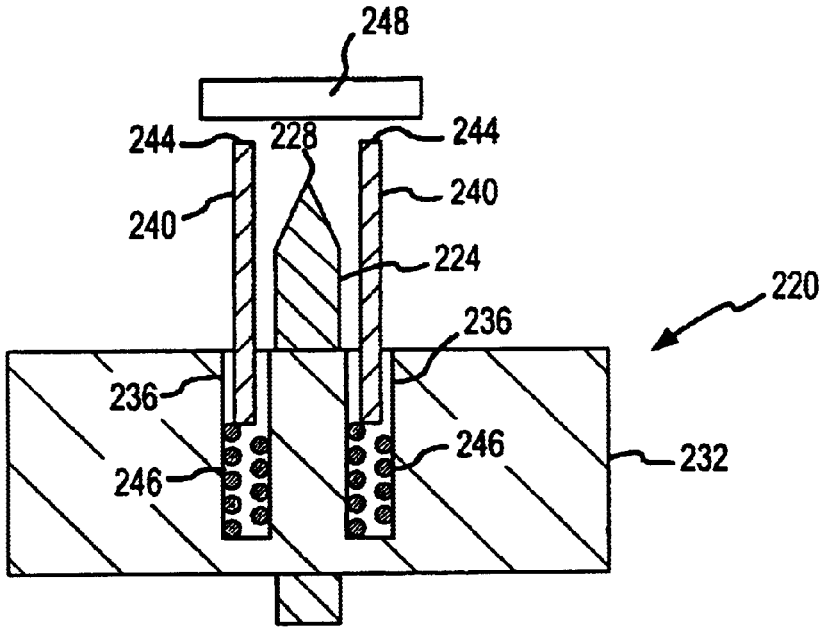
FIG. 9A is a cross-sectional view of one embodiment of an electrostatic discharge pogo pin connector.
Figure 9B:
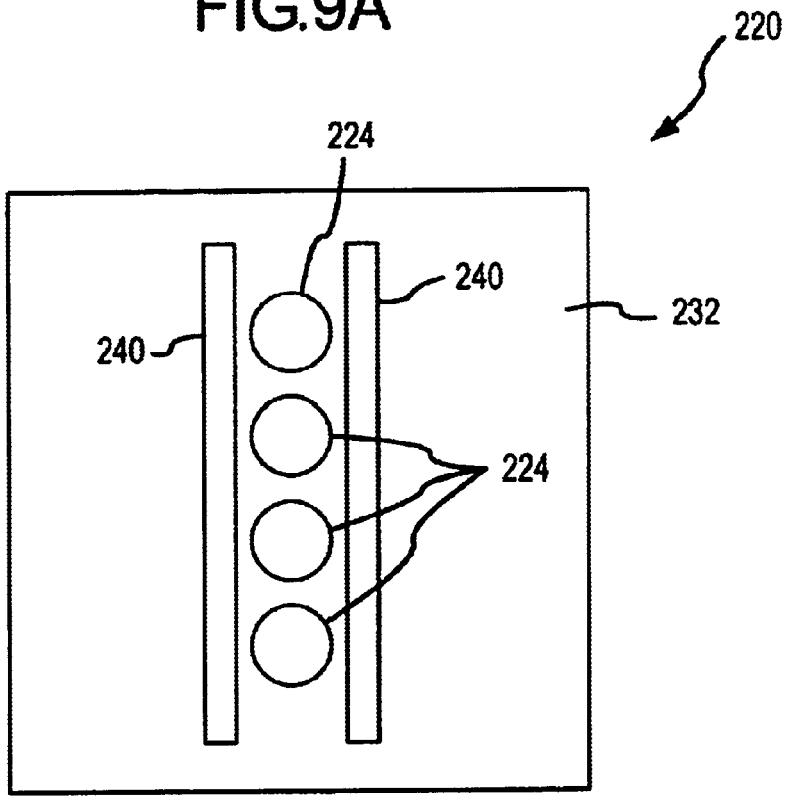
FIG. 9B is a top view of the electrostatic discharge pogo pin connector of FIG. 9A.

The principles described above in relation to the various probes may be extended to any type of device that is to be electrically interconnected with another device as noted above and including using the very same configurations discussed above. FIGS. 9A-B illustrate one such device. The pogo pin connector 220 of FIGS. 9A-B includes a housing 232. A plurality of pogo pins 224 are movably interconnected with a housing 232 and are disposed in a single row. Any number of pogo pins 224 may be utilized by the pogo pin connector 220, any number of rows of pogo pins 224 may be utilized by the pogo pin connector 220, and any arrangement of one or more pogo pins 224 may be utilized by the pogo pin connector 220. In any case, each pogo pin 224 is typically disposed within aperture formed in the housing 232 and is biased to the position illustrated in FIG. 9A (e.g., by a spring (not shown)).

The pogo pin connector 220 of FIGS. 9A–B further includes a pair of ESD conductors 240 that are also movably interconnected with the housing 232 and that are disposed on opposite sides of the row of pogo pins 224. Any number, arrangement, and configuration of ESD conductors 240 may be utilized by the pogo pin connector 220. In the case of the illustrated embodiment, the housing 232 includes a pair of slots 236, each of which receives one of the ESD conductors 240. Both ESD conductors 240 are biased to the position illustrated in FIG. 9A by a spring 246.

An end 244 of at least one of the ESD conductors 240 extends beyond the end 228 of at least one of the pogo pins 224 prior to the pogo pin connector 220 engaging the device 248. In the illustrated embodiment, the end 244 of both ESD conductors 240 extends beyond the end 228 of each of the pogo pins 244 prior to the connector 220 engaging the device 248, although such need not be the case. That is, the pogo pins 224 are recessed relative to the ESD conductor 240. This is the position illustrated in FIG. 9A. When there is relative movement of the pogo pin connector 220 toward the device 248, each ESD conductor 240 will contact an electrically conductive portion of the device 248 for at least a certain amount of time before the various pogo pins 224 are brought into contact with an electrically conductive portion of the device 248. That is, the end 244 of each of the ESD conductors 240 will initially engage the device 248 when the pogo pin connector 220 and device 248 are moved toward each other, while the ends 228 of the various pogo pins 224 will still be disposed in spaced relation to the device 248. As the pogo pin connector 220 and device 248 are further advanced toward each other, both ESD conductors 240 move relative to the pogo pins 224 by compressing their respective spring 246. After a certain amount of relative movement between the ESD conductors 240 and the various pogo pins 224, the ends 228 of the pogo pins 224 will directly contact the device 248. In the illustrated embodiment, this is when the ends 244 of both ESD conductors 240 and the ends 228 of the various pogo pins 224 are at least substantially coplanar with each other. However, this need not always be the case in order to be able to utilize the two-step electrical connection process provided by the pogo pin connector 220.

In summary, the pogo pins 224 and the ESD conductors 240 of the pogo pin connector 220 move relative to each other between at least two different positions. These two positions are generally as follows. In one position, both ESD conductors 240 are engaged with the device 248, while the pogo pins 224 are disposed in spaced relation to the device 248. Therefore, the ESD conductors 240 are electrically interconnected with the device 248 in this first relative position to allow a charge to be removed therefrom in a desired manner (e.g., slowly via the high resistance of the ESD conductors 240, and not initially through the lower resistance pogo pins 224). This is the relative position illustrated in FIG. 9A. The ESD conductors 240 also move relative to the pogo pins 224 so as to decrease the spacing between the pogo pins 224 and the device 248, and to eventually bring the pogo pins 224 into direct contact with the device 248. This defines a second relative position. Typically, both ESD conductors 240 will also remain in contact with the device 248 in this second relative position as well, although such need not always be the case in order to be able to utilize the two-step electrical connection process provided by the pogo pin connector 220. When the probe pogo pin connector 220 is disengaged from the device 248, both ESD conductors 240 move relative to the pogo pins 224 back to the position illustrated in FIG. 7 (e.g., by an appropriate biasing force being exerted on each ESD conductor 240 by their corresponding spring 246).

Figure 10:
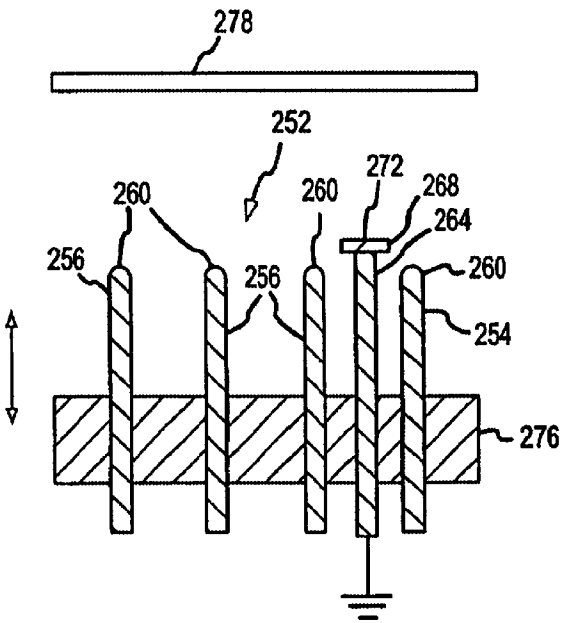
FIG. 10 is a cross-sectional view of another embodiment of an electrostatic discharge pogo pin connector.

Another pogo pin connector configuration that utilizes the principles discussed above in relation to the various probes is illustrated in FIG. 10. The pogo pin connector 252 of FIG. 10 includes a housing 276. A plurality of pogo pins 256 are movably interconnected with the housing 276. Any number of pogo pins 256 may be utilized by the pogo pin connector 252, and any arrangement of one or more pogo pins 256 may be utilized by the pogo pin connector 252. In any case, each pogo pin 256 is typically disposed within aperture formed in the housing 276 and is biased to the position illustrated in FIG. 10 (e.g., by a spring (not shown)).

The pogo pin connector 252 of FIG. 10 further includes at least one pogo pin 264 that is also movably interconnected with the housing 232 and that includes an ESD conductor 268 on an end thereof. Any number, arrangement, and configuration of pogo pins 264 with ESD conductors 268 may be utilized by the pogo pin connector 252. In any case, each pogo pin 264 with an ESD conductor 268 disposed thereon is typically disposed within aperture formed in the housing 276 and is biased to the position illustrated in FIG. 10 (e.g., by a spring (not shown)).

An end 272 of at least one ESD conductor 268 extends beyond the end 260 of at least one of the pogo pins 256 prior to the pogo pin connector 252 engaging a device 278. In the illustrated embodiment, the end 272 of the ESD conductor 268 extends beyond the end 260 of each of the pogo pins 256, although such need not be the case. That is, the pogo pins 256 are recessed relative to the ESD conductor 268. This is the position illustrated in FIG. 10. When there is relative movement of the pogo pin connector 252 toward the device 278, each ESD conductor 268 will contact an electrically conductive portion of the device 278 for at least a certain amount of time before the various pogo pins 256 are brought into direct contact with an electrically conductive portion of the device 278. That is, the end 272 of each of the ESD conductors 268 will initially engage the device 278 when the pogo pin connector 252 and device 278 are moved toward each other, while the ends 260 of the various pogo pins 256 will still be disposed in spaced relation to the device 278. As the pogo pin connector 252 and device are further advanced toward each other, each ESD conductor 268 moves relative to the pogo pins 256 by compressing the spring of the associated pogo pin 264. After a certain amount of relative movement between the ESD conductor(s) 268 and the various pogo pins 256, the ends 260 of the pogo pins 256 will contact the device 278 to establish a desired electrical connection between the pogo pin connector 252 and the device 278. In the illustrated embodiment, this is when the end 272 of the ESD conductor 268 and the ends 260 of the various pogo pins 256 are at least substantially coplanar with each other. However, this need not always be the case in order to be able to utilize the two-step electrical connection process provided by the pogo pin connector 252.

In summary, the pogo pins 256 and the ESD conductor(s) 268 of the pogo pin connector 252 move relative to each other between at least two different positions. These two positions are generally as follows. In one position, the ESD conductor(s) 268 is engaged with the device 278, while the pogo pins 256 are disposed in spaced relation to the device. Therefore, the ESD conductor(s) 268 is electrically interconnected with the device 278 in this first relative position to allow a charge to be removed therefrom in a desired manner (e.g., slowly via the high resistance of the ESD conductor 268, and not initially through the lower resistance pogo pins 256). This is the relative position illustrated in FIG. 10. The ESD conductor(s) 268 also move relative to the pogo pins 256 so as to decrease the spacing between the pogo pins 256 and the device 278, and to eventually bring the pogo pins 256 into direct contact with the device 278. This defines a second relative position. Typically, the ESD conductor(s) 268 will also remain in contact with the device 278 in this second relative position as well, although such need not always be the case in order to be able to utilize the two-step electrical connection process provided by the pogo pin connector 252. When the pogo pin connector 252 is disengaged from the device 278, the ESD conductor(s) 268 move relative to the pogo pins 256 back to the position illustrated in FIG. 10 (e.g., by an appropriate biasing force being exerted on the ESD conductor(s) 268 by the spring of the corresponding pogo pin 264).

Figure 11A:
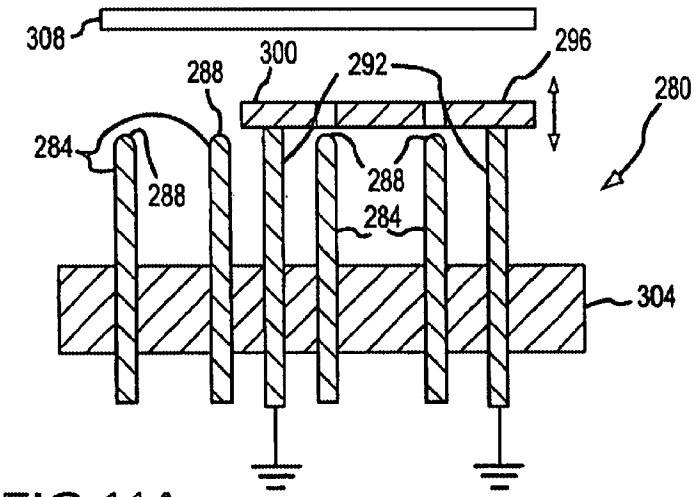
FIG. 11A is a cross-sectional view of another embodiment of an electrostatic discharge pogo pin connector in a first position.
Figure 11B:
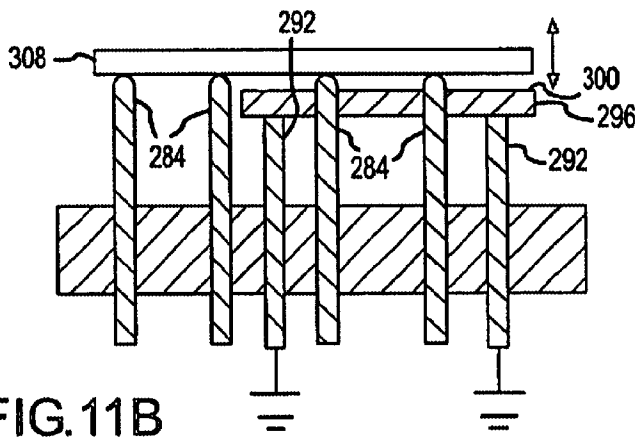
FIG. 11B is a cross-sectional view of another embodiment of an electrostatic discharge pogo pin connector in a second position.

Another pogo pin connector configuration that utilizes the principles discussed above in relation to the various probes is illustrated in FIGS. 11A–B. The pogo pin connector 280 of FIGS. 11A–B includes a housing 304. A plurality of pogo pins 284 are movably interconnected with the housing 304. Any number of pogo pins 284 may be utilized by the pogo pin connector 280, and any arrangement of one or more pogo pins 284 may be utilized by the pogo pin connector 280 as well. In any case, each pogo pin 284 is typically disposed within aperture formed in the housing 304 and are biased to the position illustrated in FIG. 11A (e.g., by a spring).

The pogo pin connector 280 of FIGS. 11A–B further includes at least two pogo pins 292 that are also movably interconnected with the housing 304. A single ESD conductor 296 is disposed on an end of each of these pogo pins 292. Any number, arrangement, and configuration of pogo pins 292 with ESD conductors 296 may be utilized by the pogo pin connector 280. In any case, each pogo pin 292 with an ESD conductor 296 disposed thereon is typically disposed within aperture formed in the housing 304 and is biased to the position illustrated in FIG. 11A (e.g., by a spring (not shown)).

An end 300 of at least one ESD conductor 296 extends beyond the end 288 of at least one of the pogo pins 284 prior to the pogo pin connector 280 engaging a device 308. In the illustrated embodiment, the end of the ESD conductor 296 extends beyond the end 288 of each of the pogo pins 284. This is the position illustrated in FIG. 11A. When there is relative movement of the pogo pin connector 280 toward the device 308, the ESD conductor(s) 296 will contact an electrically conductive portion of the device 308 for at least a certain amount of time before the various pogo pins 284 are brought into direct contact with an electrically conductive portion of the device 308. That is, the end 300 of the ESD conductor(s) 296 will initially engage the device 308 when the pogo pin connector 280 and device 308 are moved toward each other, while the ends 288 of the various pogo pins 284 will still be disposed in spaced relation to the device 308. As the pogo pin connector 280 and device 308 are further advanced toward each other, the ESD conductor (s) 296 moves relative to the pogo pins 284 by compressing the spring of the associated pogo pins 292. After a certain amount of relative movement between the ESD conductor(s) 296 and the various pogo pins 284, the ends 288 of the pogo pins 284 will contact the device 308 (FIG. 11B). At least some of the pogo pins 284 pass through an appropriate aperture formed in the ESD conductor 296 to make contact with the device 308. In the illustrated embodiment, the end 272 of the ESD conductor(s) 268 and the ends 288 of the various pogo pins 284 are not coplanar with each other. However, this need not always be the case in order to be able to utilize the two-step electrical connection process provided by the pogo pin connector 280.

In summary, the pogo pins 284 and the ESD conductor(s) 296 of the pogo pin connector 280 move relative to each other between at least two different positions. These two positions are generally as follows. In one position, the ESD conductor(s) 296 is engaged with the device 308, while the pogo pins 284 are disposed in spaced relation to the device 308. Therefore, the ESD conductor(s) 296 is electrically interconnected with the device 308 in this first relative position to allow a charge to be removed therefrom in a desired manner (e.g., slowly via the high resistance of the ESD conductor 296, and not initially through the lower resistance pogo pins 284). This is the relative position illustrated in FIG. 11A. The ESD conductor(s) 296 also move relative to the pogo pins 284 so as to decrease the spacing between the pogo pins 284 and the device 308, and to eventually bring the pogo pins 284 into direct contact with the device 308. This defines a second relative position and is illustrated in FIG. 11B. Typically, the ESD conductor(s) 296 will also remain in contact with the device 308 in this second relative position as well, although such need not always be the case in order to be able to utilize the two-step electrical connection process provided by the pogo pin connector 280. When the pogo pin connector 280 is disengaged from the device 308, the ESD conductor 296 move relative to the pogo pins 284 back to the position illustrated in FIG. 11A (e.g., by an appropriate biasing force being exerted on the ESD conductor(s) 296 by the spring of the corresponding pogo pin 292).

Figure 12:
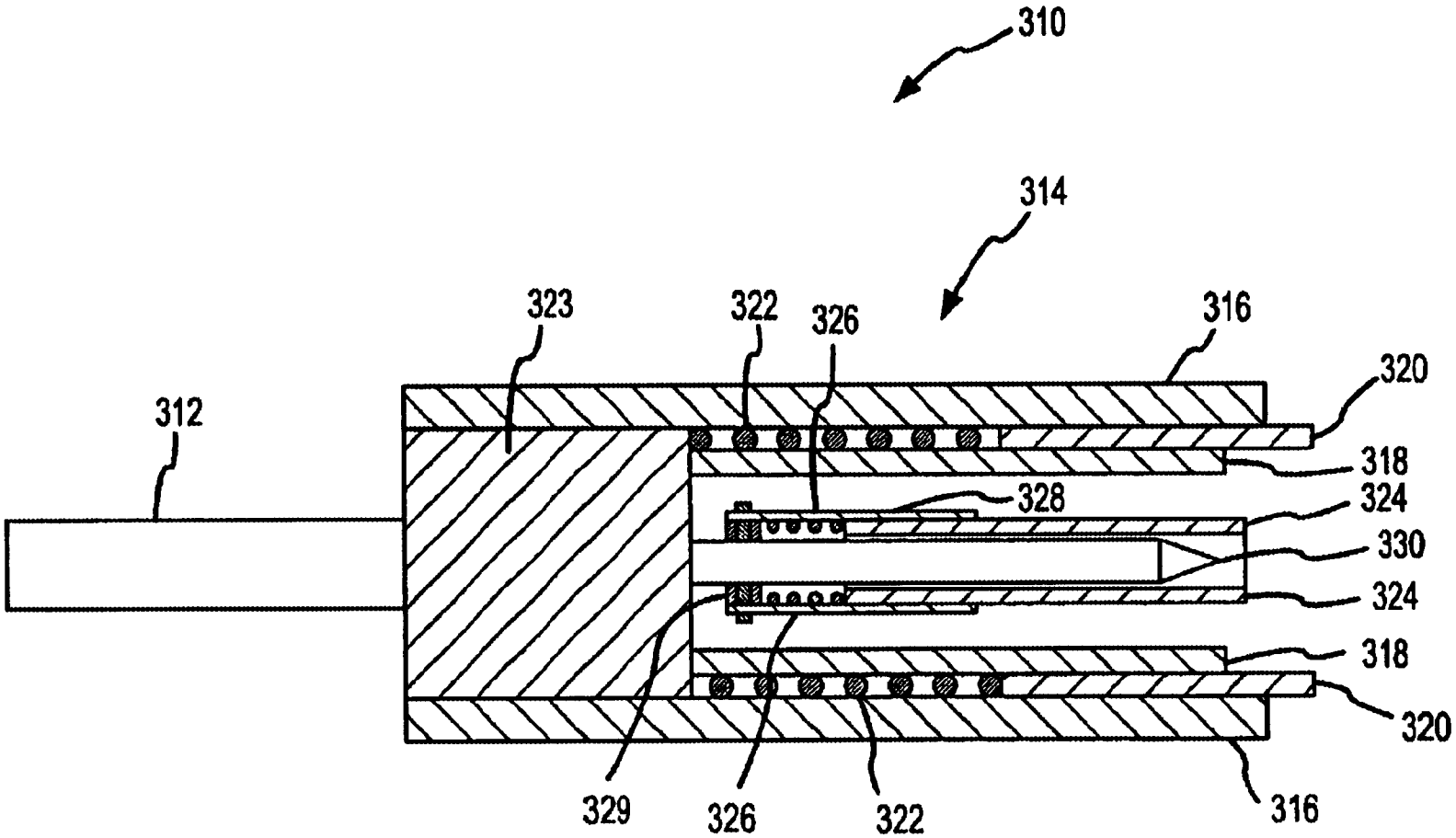
FIG. 12 is a cross-sectional view of one embodiment of an electrostatic discharge coaxial cable.

One embodiment of an electrostatic discharge coaxial cable 310 is illustrated in FIG. 12. The coaxial cable 310 includes what may be characterized as a conduit 312 (e.g., a center wire/conductor surrounded by insulation, that is in turn surrounded by a grounded shield (e.g. braided wire)) and a connector 314 that is appropriately both structurally and electrically interconnected with the conduit 312. The connector 314 includes an annular outer housing 316 and a concentrically disposed annular inner housing 318. In one embodiment the outer housing 316 is metal and is electrically interconnected with the grounded shield of the conduit 312. An outer ESD conductor 320 is disposed between the outer housing 316 and the inner housing 318. One end of the outer ESD conductor 320 extends beyond the distal end of both the outer housing 316 and the inner housing 318. An opposite end of the outer ESD conductor 320 is seated against one end of an annular outer spring 322 that is also disposed between the outer housing 316 and the inner housing 318. An opposite end of the outer spring 322 engages an end cap 323 that is fixed relative to the outer housing 316 and the inner housing 318.

The connector 314 further includes an annular center pin housing 328 that is disposed about and spaced from the center pin 330. In one embodiment the center pin housing 328 is metal and is electrically isolated from the center pin 330. An annular inner ESD conductor 324 is disposed between the center pin housing 328 and the center pin 330. One end of the inner ESD conductor 324 extends beyond the distal end of both the center pin housing 328 and the center pin 330. An opposite end of the inner ESD conductor 324 is seated against one end of an annular inner spring 322 that is also disposed between the center pin housing 328 and the center pin 330. An opposite end of the outer spring 322 engages an end cap 329 of the center pin housing 328.

The ESD coaxial cable 310 provides for a two-step electrical connection with another electrical device in relation to both the outer housing 316 and the center pint 330, each of which happens at least generally in the manner discussed above in relation to the various probe and pogo pin connector embodiments discussed above. The outer housing 316 and the outer ESD conductor 320 move relative to each other between at least two different positions to provide a two-step electrical connection in relation to the outer housing 316. These two positions are generally as follows. In one position, the outer ESD conductor 320 is engaged with the device that is to be electrically interconnected with the ESD coaxial cable 310, while the outer housing 316 is disposed in spaced relation to this device. Therefore, the outer ESD conductor 320 is electrically interconnected with the device in this first relative position to allow a charge to be removed therefrom in a desired manner (e.g., slowly via the high resistance of the outer ESD conductor 320, and not initially through the lower resistance outer housing 316). This defines a first relative position.

The outer ESD conductor 320 also moves relative to the outer housing 316 so as to decrease the spacing between the distal end of the outer housing 316 and the device, and to eventually bring distal end of the outer housing 316 into direct contact with the device. This defines a second relative position and is provided by a compression of the outer spring 322. Typically, the outer ESD conductor 320 will also remain in contact with the device in this second relative position as well, although such need not always be the case in order to be able to utilize the two-step electrical connection process provided by the ESD coaxial cable 310. When the ESD coaxial cable 310 is disengaged from the device, the outer ESD conductor 320 moves relative to the outer housing 316 back to the position illustrated in FIG. 12 (e.g., by an appropriate biasing force being exerted on the outer ESD conductor 320 by the outer spring 322).

The inner ESD conductor 324 and the center pin 330 also move relative to each other between at least two positions to provide a two-step electrical connection in relation to the center pin 330. These two positions are generally as follows. In one position and typically after electrical contact has been established between the device and the outer housing 316, the inner ESD conductor 324 is engaged with the device that is to be electrically interconnected with the ESD coaxial cable 310, while the center pin 330 is disposed in spaced relation to this device. It should be appreciated that the outer ESD conductor 320 and the inner ESD conductor 324 could simultaneously contact the device. In any case, the inner ESD conductor 324 is electrically interconnected with the device in this first relative position to allow a charge to be removed therefrom in a desired manner (e.g., slowly via the high resistance of the inner ESD conductor 324 , and not initially through the lower resistance center pin 330). This defines a first relative position.

The inner ESD conductor 324 also moves relative to center pin 330 so as to decrease the spacing between the distal end of the center pin 330 and the device, and to eventually bring the distal end of the center pin 330 into direct contact with the device. This defines a second relative position and is provided by a compression of the inner spring 326. Typically, the inner ESD conductor 324 will also remain in contact with the device in this second relative position as well, although such need not always be the case in order to be able to utilize the two-step electrical connection process provided by the ESD coaxial cable 310. When the ESD coaxial cable 310 is disengaged from the device, the inner ESD conductor 324 moves relative to the center pin 330 back to the position illustrated in FIG. 12 (e.g., by an appropriate biasing force being exerted on the inner ESD conductor 324 by the inner spring 326).

Any configuration may be utilized that allows for the two-step electrical interconnection in relation to each of the outer housing 315 and the center pin 330 of the ESD coaxial cable 310. What is of importance is that the outer ESD conductor 320 contact the device prior to the outer housing 316, and that the inner ESD conductor 324 contact the device before the center pin 330.

The configurations used by the above-described pogo pin connectors 220, 252 and 280, as well as by the ESD coaxial cable 310, to establish a multi-step electrical connection with another device may be used by any device to establish an electrical connection with any other device.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A method for making a second device using a first device, wherein said first device comprises first and second conductors, wherein said first conductor is a ball that is disposed within an aperture in said second conductor, wherein said first conductor has a significantly larger resistance than said second conductor, wherein said method comprises the steps of:

moving said first device relative to said second device; executing a first contacting step comprising contacting said second device with said first conductor during said moving said first device step;

moving said first conductor relative to said second conductor after said second device contacts said first conductor and while continuing to perform said moving said first device step; and executing a second contacting step comprising contacting said second device with said second conductor after a first amount of relative movement between said first and second conductors from said moving said first conductor step.

2. A method, as claimed in claim 1, wherein:

said moving said first conductor step comprises forcing said first conductor against a spring and compressing said spring.

3. A method, as claimed in claim 1, wherein:

said moving said first conductor step comprises moving said first conductor from a first position to a second position.

4. A method, as claimed in claim 3, wherein:

said executing a second contacting step is unable to be performed with said first conductor in said first position, and wherein said executing a second contacting step is able to be performed after said first conductor reaches said second position.

5. A method, as claimed in claim 3, wherein:

said executing a second contacting step is initiated only after said first conductor reaches said second position.

6. A method, as claimed in claim 1, wherein:

said moving said first conductor step comprises changing a position of said first conductor, and wherein said executing a second contacting step comprises exposing said second conductor to said second device by said changing step.

7. A method, as claimed in claim 1, wherein:

said executing a second contacting step is initiated only after dissipating at least a certain amount of charge from said second device through said first conductor from said executing a first contacting step.

8. A method, as claimed in claim 1, wherein:

said executing a second contacting step is initiated after a potential difference between said first and second devices is no more than about 1 volt from said executing a first contacting step.

9. A method, as claimed in claim 1, wherein:

said executing a second contacting step is performed while said executing a first contacting step continues to be performed.

10. A method, as claimed in claim 1, wherein:

said first conductor has a resistance of at least about $1\times10^6$ ohms.

11. A method, as claimed in claim 1, wherein:

said first conductor has a resistance that is at least about $1\times10^6$ ohms greater than a resistance of said second conductor.

12. A method, as claimed in claim 1, wherein:

said first conductor comprises a static dissipative material.

13. a method, as claimed in claim 2, wherein:

a first moving step comprises said moving said first device step, wherein said method further comprises the steps of:

terminating said first moving step;

executing a second moving step comprising moving said first device relative to said second device in a direction that is opposite of a direction associated with said first moving step, wherein said second moving step is executed after said terminating step; and expanding said spring during said second moving step.

14. A method as claimed in claim 13, wherein:

a third moving step comprises said moving said first conductor step, and wherein said method further comprises the step of executing a fourth moving step comprising moving said first conductor relative to said second conductor in a direction that is opposite of a direction associated with said third moving step, wherein said fourth moving step uses said expanding step.

15. A method, as claimed in claim 3, further comprising the step of:

exerting a biasing force on said first conductor during said moving said first conductor step.

16. A method, as claimed in claim 3, further comprising the step of:

biasing said first conductor toward said first position.

17. A method of making a second device using a first device, wherein said first device comprises first and second conductors, wherein said first conductor is a ball that is disposed within an aperture in said second conductor, wherein said first conductor has a significantly larger resistance than said second conductor, wherein said method comprises the steps of:

executing a first contacting step comprising contacting said second device with said fire conductor;

moving said first conductor while continuing to perform said executing a first contacting step; and executing a second contacting step comprising contacting said second device with said second conductor after a first amount of movement of said first conductor from said moving said first conductor step.

18. A method, as claimed in claim 17, wherein:

said moving step comprises forcing said first conductor against a spring and compressing said spring.

19. A method, as claimed in claim 17, wherein:

said moving step comprises moving said first conductor from a first position to a second position.

20. A method, as claimed in claim 19, wherein:

said executing a second contacting step is unable to be performed with said first conductor in said first position, and wherein said executing a second contacting step is able to be performed after said first conductor reaches said second position.

21. A method, as claimed in claim 19, wherein:

said executing a second contacting step is initiated only after said first conductor reaches said second position.

22. A method, as claimed in claim 17, wherein:

said moving step comprises changing a position of said first conductor, and wherein said executing a second contacting step comprises exposing said second conductor to said second device by said changing step.

23. A method, as claimed in claim 17, wherein:

said executing a second contacting step is initiated only after dissipating at least a certain amount of charge from said second device through said first conductor from said executing a first contacting step.

24. A method, as claimed in claim 17, wherein:

said executing a second contacting step is initiated after a potential difference between said first and second devices is no more than about 1 volt from said executing a first contacting step.

25. A method, as claimed in claim 17, wherein:

said executing a second contacting step is performed while said executing a first contacting step continues to be performed.

26. A method, as claimed in claim 17, wherein:

said first conductor has a resistance of at least about $1\times10^6$ ohms.

27. A method, as claimed in claim 17, wherein:

said first conductor has a resistance that is at least about 1×10ohms greater than a resistance of said second conductor.

28. A method, as claimed in claim 17, wherein:

said first conductor comprises a static dissipative material.

29. A method, as claimed in claim 17, further comprising the steps of:

executing a first moving step comprising moving said first device relative to said second device, wherein said moving said first conductor step is in response to said first moving step; and executing a second moving step that comprises moving said first device relative to said second device in a direction that is opposite of a direction associated with said first moving step.

30. A method, as claimed in claim 18, further comprising the steps of:

executing a first moving step comprising moving said first device relative to said second device, wherein said moving said first conductor step is in response to said first moving step; and executing a second moving step that comprises moving said first device relative to said second device in a direction that is opposite of a direction associated with said first moving step.

31. A method, as claimed in claim 30, further comprising the steps of:

terminating said first moving step; and expanding said spring during said second moving step.

32. A method, as claimed in claim 31, wherein:

a third moving step comprises said moving said first conductor step, wherein said method further comprises the step of executing a fourth moving step comprising moving said first conductor in a direction that is opposite of a direction associated with said third moving step, wherein said fourth moving step uses said expanding step.

33. A method, as claimed in claim 19, further comprising the step of:

exerting a biasing force on said first conductor during said moving step.

34. A method, as claimed in claim 19, further comprising the step of:

biasing said first conductor toward said first position.

35. A method of making a second device using a first device, wherein said first device comprises first and second conductors, wherein said first conductor is a ball that is disposed within an aperture in said second conductor, wherein said first conductor has a significantly larger resistance than said second conductor, wherein said method comprises the steps of:

contacting said second device with said first conductor;

changing a position of said first conductor while said first conductor remains in contact with said second device; and engaging said second conductor to said second device based at least in part on said changing step.

36. A method, as claimed in claim 35, wherein:

changing step comprises compressing a spring by moving said first conductor.

37. A method, as claimed in claim 35, wherein:

said changing step comprises moving said first conductor from a first position to a second position.

38. A method, as claimed in claim 37, wherein:

said engaging step is unable to be performed with said first conductor in said first position, and wherein said engaging step is able to be performed after said first conductor reaches said second position.

39. A method, as claimed in claim 37, wherein:

said engaging step is initiated only after said first conductor reaches said second position.

40. A method, as claimed in claim 35, wherein:

said engaging step is initiated only after dissipating at least a certain amount of charge from said second device through said first conductor from said contacting step.

41. A method, as claimed in claim 35, wherein:

said engaging step is initiated after a potential difference between said first and second devices is no more than about 1 volt from said contacting step.

42. A method, as claimed in claim 35, wherein:

said engaging step is performed while said contacting step continues to be performed.

43. A method, as claimed in claim 35, wherein:

said first conductor has a resistance of at least about $1\times10^6$ ohms.

44. A method, as claimed in claim 35, wherein:

said first conductor has a resistance that is at least about $1\times10^6$ ohms greater than a resistance of said second conductor.

45. A method, as claimed in claim 35, wherein:

said first conductor comprises a static dissipative material.

46. A method, as claimed in claim 36, further comprising the steps of:

executing a first moving step comprising moving said first device relative to said second device, wherein said changing step is in response to said first moving step; and executing a second moving step that comprises moving said first device relative to said second device in a direction that is opposite of a direction associated with said fist moving step.

47. A method, as claimed in claim 46, further comprising the steps of:

terminating said first moving step; and expanding said spring during said second moving step.

48. A method, as claimed in claim 47, further comprising the step of:

executing a second changing step comprising changing a position of said first conductor using said expanding step.

49. A method, as claimed in claim 37, further comprising the step of:

exerting a biasing force on said first conductor during said changing step.

50. A method, as claimed in claim 37, further comprising the step of:

biasing said first conductor toward said first position.

* * * * *

UNITED STATES PATENT AND TRADEMARK OFFICE

CERTIFICATE OF CORRECTION

PATENT NO. : 6,905,350 B1
DATED : June 14, 2005
INVENTOR(S) : Wallash et al.

It is certified that error appears in the above-identified patent and that said Letters Patent is hereby corrected as shown below:

Column 29,
Line 20, delete “fire”, and insert therefor -- first --; and
Line 66, delete “1x10ohms”, and insert therefor -- $1x10^6$ ohms --.

Column 32,
Line 8, delete “fist”, and insert therefor -- first --.

Signed and Sealed this

Twenty-third Day of August, 2005

JON W. DUDAS
*Director of the United States Patent and Trademark Office*